US007857675B2

(12) United States Patent
Horikawa et al.

(10) Patent No.: US 7,857,675 B2
(45) Date of Patent: Dec. 28, 2010

(54) PLASMA DISPLAY PANEL AND METHOD FOR PRODUCING THE SAME

(75) Inventors: Akihiro Horikawa, Osaka (JP); Toshifumi Nagino, Osaka (JP)

(73) Assignee: Panasonic Corporation, Osaka (JP)

( * ) Notice: Subject to any disclaimer, the term of this patent is extended or adjusted under 35 U.S.C. 154(b) by 275 days.

(21) Appl. No.: 12/057,024

(22) Filed: Mar. 27, 2008

(65) Prior Publication Data

US 2008/0272684 A1 Nov. 6, 2008

(30) Foreign Application Priority Data

Mar. 28, 2007 (JP) ..... 2007-084608

(51) Int. Cl.
*H01J 9/00* (2006.01)

(52) U.S. Cl. ..... 445/30

(58) Field of Classification Search ..... 313/582–587; 445/30

See application file for complete search history.

(56) References Cited

U.S. PATENT DOCUMENTS

| | | | | |
|---|---|---|---|---|
| 5,714,286 | A * | 2/1998 | Uchikawa et al. | 430/6 |
| 6,113,449 | A * | 9/2000 | Sung et al. | 445/24 |
| 6,891,331 | B2 * | 5/2005 | Ashida et al. | 313/582 |
| 7,034,458 | B2 * | 4/2006 | Asida et al. | 313/582 |
| 7,459,852 | B2 | 12/2008 | Hong et al. | |
| 7,491,107 | B2 * | 2/2009 | Adachi | 445/46 |
| 2003/0066950 | A1 * | 4/2003 | Halls et al. | 250/214.1 |
| 2003/0215747 | A1 * | 11/2003 | Kim et al. | 430/284.1 |
| 2004/0075386 | A1 * | 4/2004 | Hoshino et al. | 313/582 |
| 2004/0214111 | A1 * | 10/2004 | Mun et al. | 430/319 |
| 2005/0104520 | A1 | 5/2005 | Hong et al. | |
| 2007/0013311 | A1 * | 1/2007 | Moon et al. | 313/586 |

FOREIGN PATENT DOCUMENTS

| | | |
|---|---|---|
| JP | 2004-63247 | 2/2004 |
| JP | 2005-26138 | 1/2005 |
| JP | 2005-150109 | 6/2005 |
| KR | 10-2005-0023839 | 3/2005 |

* cited by examiner

*Primary Examiner*—Nimeshkumar D Patel
*Assistant Examiner*—Jacob Stern
(74) *Attorney, Agent, or Firm*—Wenderoth, Lind & Ponack, L.L.P.

(57) ABSTRACT

A method for producing a plasma display panel wherein the projection of the end portions of electrode in the widthwise direction are suppressed so that failure in insulation and pressure proof is not caused upon forming an electrode pattern by collectively exposing and developing a bus electrode having a two-layered structure. When the electrode pattern having two-layered structure by a photolithography method using a mask, exposure is made by applying light, while a part of a surface of portion of a paste film of an electrode material which portion to be formed into the electrode pattern is shield from the light, so that a dent is formed in the electrode surface after developing and the thermal shrinkage of the center portion and the thermal shrinkage of the end portions of the electrode in the widthwise direction are controlled separately by the dent.

18 Claims, 13 Drawing Sheets

PLASMA DISPLAY PANEL AND METHOD FOR PRODUCING THE SAME

BACKGROUND OF THE INVENTION

The present invention relates to a plasma display panel and a method for producing a plasma display panel. In particular, the present invention pertains to a plasma display panel characterized by the surface configurations of the electrodes on its front panel, and a method for producing a plasma display panel.

A plasma display panel (hereinafter referred to as PDP) has a structure comprising a front panel and a back panel arranged facing each other, which are sealed at their peripheral portions; and discharge gases such as neon (Ne), xenon (Xe) and the like are sealed in a discharge space defined between the front panel and the back panel.

The front panel is provided with a plurality of display electrodes each consisting of a scan electrode and a sustain electrode forming stripes, which are formed on one surface of a glass substrate, and a dielectric layer and a protective layer which cover these display electrodes. Each of the display electrodes comprises a transparent electrode and a bus electrode formed of a metal material on the transparent electrode.

The back panel is provided with a plurality of address electrodes forming the stripes which are formed on one surface of a glass substrate in a direction orthogonal to the display electrodes, a base dielectric layer which covers these address electrodes, striped partition walls which section the discharge space at every one of the address electrodes, and red, green and blue fluorescent layers formed in this order on each of the grooves defined by the partition walls.

The display electrodes and the address electrodes are orthogonal to each other so that their intersecting portions constitute discharge cells. These discharge cells are disposed in a matrix; and a pixel for color display is composed of three cells which have red, green and blue fluorescent layers, respectively, and which are disposed in the direction of the display electrodes. The PDP displays a colored image as follows: a predetermined voltage is sequentially applied between the scan electrodes and the address electrodes and between the scan electrodes and the sustain electrodes to cause a gas discharge, so that a UV caused by the gas discharge excites the fluorescent layers so as to emit light therefrom for the colored image.

When an aluminum (Al) electrode or a chromium (Cr)/copper (Cu)/chromium (Cr) electrode is used as the bus electrode, the electrode is formed by the steps of film-forming and patterning based on the semiconductor process. The bus electrode is therefore formed with high precision, but costs more since a vacuum apparatus is needed to form the film layer by the sputtering process. To solve this disadvantage, for example, bus electrodes of silver (Ag) are often formed of paste comprising silver (Ag) powder, by the printing method or the roll coating method which does not need a special vacuum apparatus.

The electrode paste using the silver (Ag) powder includes silver (Ag) powder as a solid component which is a conductive agent, glass frit for use in bonding, a resin such as a cellulose resin as a medium component, and a solvent such as a terpene-based solvent.

To improve the contrast of a screen, lately, there is provided a bus electrode which has a two-layered structure comprising a black layer (a layer in contact with a transparent layer) formed on the display side and a white layer formed on the black layer. The black layer is formed by applying a black electrode paste, and the white layer is formed by applying a conductive electrode paste on the black layer. In this case, as the black electrode paste, a resin composition comprising a black composite oxide of copper-iron (Cu—Fe), copper-chromium (Cu—Cr) or the like is used.

In concrete terms, the bus electrode is formed of these electrode pastes by applying each of the electrode pastes for each layer, and pattering each of the resulting layers (exposure and development), and calcining each of the resulting layers. To manufacture a PDP by a decreased number of steps, there are disclosed a method of collectively developing both layers which constitute a bus electrode having a two-layered structure and a black matrix; or a method of collectively exposing and developing a black layer and a white layer (cf. JP-A-2004-63247). The method disclosed in this patent document is expected to enable efficient formation of electrodes.

SUMMARY OF THE INVENTION

As a result of the present inventors' investigation, the collective exposure of the black layer and the white layer as described in JP-A-2004-63247 is found to make it insufficient for light to reach the lower layer, for which the curing of the lower layer becomes insufficient. Consequently, the amount of the insufficiently cured lower layer to be removed during development becomes larger than that of the upper layer. After the development, the width of the lower layer is smaller relative to the width of the upper layer. The schematic sectional view of such a bus electrode is shown in FIG. 3.

When such an electrode is calcined, shrinking forces as shown in FIG. 4 are applied on the white layer and the black layer, respectively, to cause a resultant force as shown in FIG. 5. In the region 4 where the black layer is left to remain after the development, offset of the interfacial forces from the white layer and the black layer as shown in FIG. 4 occurs during the calcining step. Accordingly, a large force 7 directed to the glass substrate is applied as the resultant force at the surface portion of the white layer, as shown in FIG. 5. In the region 5 where parts of the black layer are removed during the development, forces 8 shrinking the white layer toward the inside thereof are caused independently of the black layer, as shown in FIG. 4.

As a result of the action of these forces, as shown in FIG. 5, forces 9 pulling the end portions of the white layer in the widthwise direction to the center portion thereof are caused at the surface of the white layer, by a resultant force of the large resultant force 7 which is directed to the glass substrate and which acts at the surface of the white layer, with the forces 8 shrinking the white layer toward the inside thereof. When the forces 9 act, the white layer is largely bent, and the end portions of the white layer in the widthwise direction are turned up and are largely projected upward. When a PDP is manufactured using the electrodes projected as above, a dielectric material becomes thinner at such projected portions; or electric charges locally concentrate on the projected portions, when a voltage is applied to the electrodes. As a result, failures in insulation and pressure proof are more likely to occur, and the manufacturing yield becomes lower, which results in higher manufacturing costs.

Recently, the demands for far higher definition and lower costs of PDPs have become greater. To satisfy such demands, it is essential to stably produce PDPs in high yield and at low costs, without causing any failure in insulation and pressure proof, even when far more electrodes are disposed. Under such a situation, there is a problem that a production has not yet been realized wherein a bus electrode is made by a decreased number of steps, that is, by collectively exposing and developing two layers for the bus electrode, while preventing failures in insulation and pressure proof in the electrode.

The present invention is developed to solve the foregoing problem, and objects of the invention are to provide a PDP characterized by the surface configuration of a pattern of electrodes having two-layered structures, wherein the end portions of each electrode in the widthwise direction are inhibited from projecting so that higher performance for insulation and pressure proof can be exhibited, and to provide a method for producing such a PDP.

To achieve the above objects, the present invention provides a method for producing a plasma display panel, including the steps of forming a first layer by applying a first material for an electrode as a lower layer on a glass substrate;

forming a second layer by applying a second material for an electrode as an upper layer on the surface of the first layer;

exposing portions of the layers at which the electrode is to be formed, by applying light to the portions, while shielding a part of the surface of the portion from light; and developing the portions of the layers to form the electrode, wherein a member for shielding the part of the surface of the portion at which the electrode is to be formed has a dimension T in parallel to the widthwise direction of the electrode, T fulfilling 2 μm≦T≦10 μm (hereinafter the dimension is optionally referred to as "width"), and wherein the interval L between the end portion of the electrode in the widthwise direction, formed after the exposure, and the end portion of the above light-shielding member in the widthwise direction fulfills 1 μm≦L≦10 μm. In other words, the method of the present invention includes shielding or masking a part of the surface of the stacked layers at which the electrode are to be formed, in addition to shielding or masking a surface of the portions which are to be removed by developing (that is, not to be formed into electrode).

The wording "on the glass substrate" used herein means either the direct formation of the first layer on the surface of the glass substrate or the formation of the first layer on the surface of another layer which is formed on the surface of the glass substrate. The wording "the widthwise direction of the electrode" means a direction in which the electrode extends shorter, orthogonal to a direction in which the electrode extends longer, provided that the electrode is two-dimensionally viewed (that is, in this case, the thickness of the electrode is taken out of consideration). Accordingly, the direction in which the electrode extends longer is referred to as "the lengthwise direction of the electrode".

When an electrode having two layers is formed by the above-described method, it becomes possible to form a recess on the surface of the electrode after the development, and thus, it is considered that the thermal shrinkage of the center portion and the thermal shrinkage of the end portions of the electrode in the widthwise direction can be controlled separately. As a result, an electrode can be formed wherein the bending of the upper layer and the projection of the end portions of the upper layer in the widthwise direction are suppressed. Thus, a PDP having high performance for insulation and pressure proof can be provided. This method is preferably applied to form a bus electrode comprising a white layer and a black layer.

In the above-described exposure, the width T of the light-shielding member preferably fulfills 2 μm≦T≦10 μm, and preferably, the light-shielding member having such a width covers the surface of a portion at which the electrode is to be formed so that the interval L between the end portion of the electrode in the widthwise direction, formed after the exposure, and the end portion of the above light-shielding member in the widthwise direction fulfills 1 μm≦L≦10 μm. When the light-shielding member having the above-described width is located as above, the thermal shrinkage of the center portion and the thermal shrinkage of the end portions of the electrode in the widthwise direction during the calcining step can be controlled separately, without causing any dent large enough to chip the electrode or lower the electrode performance, and therefore, the bending of the white layer and the projection of the end portions of the white layer in the widthwise direction can be effectively suppressed.

In the above-described exposure, the light-shielding member for shielding a part of the surface of the portion at which the electrode is to be formed (i.e., the surface of a part of the second layer) is preferably allowed to extend in a direction parallel to the lengthwise direction of the electrode. By designing the light-shielding member to have such a shape and such a length that the light-shielding member can extend in parallel to the lengthwise direction of the electrode, the thermal shrinkage of the center portion and the thermal shrinkage of the end portions of the electrode in the widthwise direction can be controlled separately inside the surface of the glass substrate, with less variability. As a result, an electrode in which the bending of the white layer and the projection of the end portions thereof in the widthwise direction of the electrode are suppressed can be more stably formed inside the surface of the glass substrate with less variability.

In the production method of the present invention, the electrode is preferably a bus electrode which is included in a display electrode constituting a front panel, and comprises a black layer located on the lower side and a white layer located on the upper side.

Also, in the method for producing a PDP of the present invention, one layer of the electrode may be formed of an electrode material which contains, as ultrafine conductive particles, particles of at least one selected from a group consisting of silver (Ag), aluminum (Al), nickel (Ni), gold (Au), platinum (Pt), chromium (Cr), copper (Cu), palladium (Pd) and alloys of these metals. The electrode formed of the electrode material containing such ultrafine conductive particles has excellent conductivity.

Also, in the method for producing a PDP of the present invention, one layer of the electrode (or the other layer, when the one layer contains the above-described ultrafine conductive particles) may be formed of an electrode material which contains ultrafine particles of tricobalt tetraoxide ($Co_3O_4$) as a black component. When a calcined film which comprises an electrode material containing such a black component is formed as the black layer of an electrode, especially a bus electrode, the electrode concurrently satisfies sufficient interlayer conductivity (e.g., interlayer current passing between a transparent electrode and a white layer, when the electrode is the bus electrode) and sufficient blackness after the calcinability step, without degrading the adhesion to the substrate, resolving power and calcinability in each of the drying, exposing, developing and calcining steps.

Also, in the method for producing the PDP of the present invention, the other layer described above may be formed of a material containing as a black component an oxide of at least one metal selected from a group consisting of chromium (Cr), cobalt (Co), nickel (Ni), iron (Fe), manganese (Mn) and ruthenium (Ru). When a calcined film which comprises an electrode material containing such a black component is formed as an electrode, particularly as a black layer, such an electrode concurrently satisfies sufficient interlayer conductivity (e.g., interlayer current passing between a transparent electrode and a white layer) and sufficient blackness after the calcining step, without degrading the adhesion to the substrate, resolution power and calcinability in each of the drying, exposing, developing and calcining steps.

The present invention also provides a plasma display panel produced by the method of the present invention. That is, a plasma display panel according to the present invention includes a pair of a front panel and a back panel, having a discharge space formed therebetween;

a plurality of display electrodes, each consisting of a scan electrode and a sustain electrode, disposed in parallel to one another on the inner surface of a substrate for the front panel; and a plurality of address electrodes disposed in a direction orthogonal to the display electrodes, partition walls which section the discharge space at every one of unit light-emitting regions, and a fluorescent material which emits light by discharge, on the inner surface of a substrate for the back panel, wherein the display electrode comprises a transparent electrode and a bus electrode formed on the transparent electrode, the bus electrode having two layers that are a black layer located on the lower side and a white layer located on the upper side, and wherein Ec is smaller than 2.0 μm, provided that Ec is a projected amount which is a difference between a height Te of the projected end portions of the bus electrode in the widthwise direction (or the height of a higher one of the projected end portions when the heights of both end portions are different) and an average height Tc of the bus electrode at the center region on condition that the width of the white layer of the bus electrode is equally divided into three regions.

In this display panel, the projected amounts of both the end portions of the bus electrode having the two-layered structure are small, in other words, the flexure of the white layer is small. Accordingly, the yield of this display panel is high, and the display panel can be stably produced. Also, in this display panel, failure in insulation and pressure proof is hard to occur, since thickness of a dielectric layer which covers the display panel is not locally decreased or a local thinning is decreased.

According to the production method of the present invention, a portion at which an electrode pattern is to be formed is exposed by applying light, while a part of the surface of such a portion is shielded from light, and such a portion is then developed to form the electrode pattern, so that it becomes possible to form a recess on the surface of the electrode after the development. As a result, the thermal shrinkage of the center portion and the thermal shrinkage of the end portions of the electrode in the widthwise direction during the calcining step can be controlled separately. Therefore, it is possible to form the electrode in which the flexure of its white layer and the projection of the end portions thereof in the widthwise direction of the electrode are suppressed. Therefore, according to this production method, it is possible to provide a PDP having high performance for insulation and pressure proof.

BRIEF DESCRIPTION OF THE DRAWINGS

FIG. 7(*b*) is a sectional view illustrating Step S2 in the flowchart of FIG. 6.

FIG. 7(*c*) is a sectional view illustrating Step S3 in the flowchart of FIG. 6.

FIG. 7(*d*) is a sectional view illustrating Step S3 in the flowchart of FIG. 6.

FIG. 7(*e*) is a sectional view illustrating Step S3 in the flowchart of FIG. 6.

DESCRIPTION OF REFERENCE NUMERALS

Figure 1:
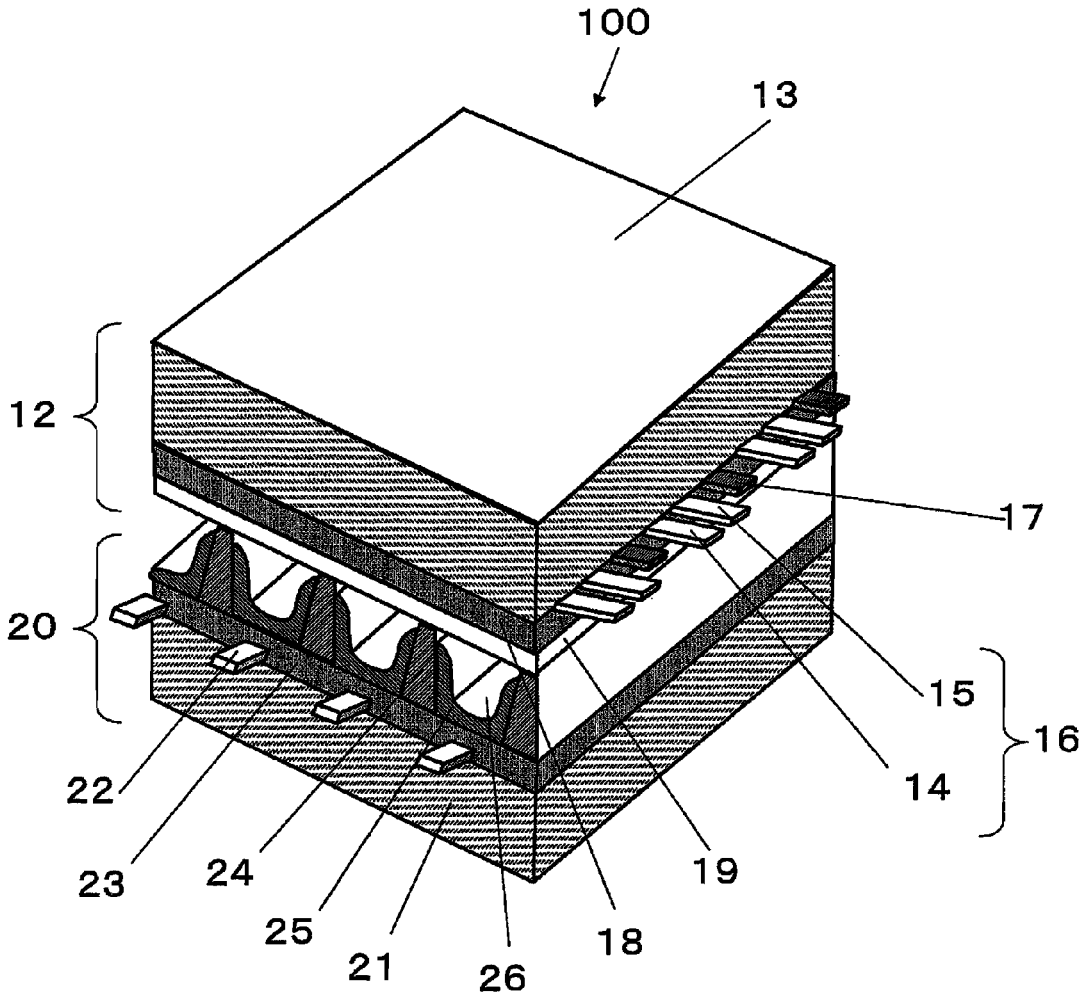
FIG. 1 is a perspective view of a PDP according to an embodiment of the present invention, illustrating the structure thereof.

4 . . . a black layer formed after development
5 . . . a region in which a part of the black layer is removed during the development
6 . . . interfacial forces from the white layer and from the black layer, which offset each other
7 . . . a resultant force directed to a glass substrate
8 . . . a force which shrinks the white layer inward
9 . . . a force which pulls the surface portion of the white layer toward the center portion thereof in the widthwise direction.
12 . . . a front panel
13 . . . a front glass substrate
14 . . . a scan electrode
14*a* or 15*a* . . . a transparent electrode
14*b* or 15*b* . . . a bus electrode
14*c* or 15*c* . . . a white layer
14*d* or 15*d* . . . a black layer
15 . . . a sustain electrode
16 . . . a display electrode
17 . . . a black stripe (a light-shielding layer)
18 . . . a dielectric layer
19 . . . a protective layer
20 . . . a back panel
21 . . . a back glass substrate
22 . . . an address electrode
23 . . . a base dielectric layer
24 . . . a partition wall
25 . . . a fluorescent layer
26 . . . a discharge space
31 . . . an exposure mask
32 . . . a light-shielding member

33 . . . recesses filled
100 . . . a plasma display panel

DETAILED DESCRIPTION OF THE PREFERRED EMBODIMENTS

Hereinafter, the method for producing a PDP according to an embodiment of the present invention, and the structure of the PDP produced by the same method will be described with reference to the accompanying drawings.

Figure 2:
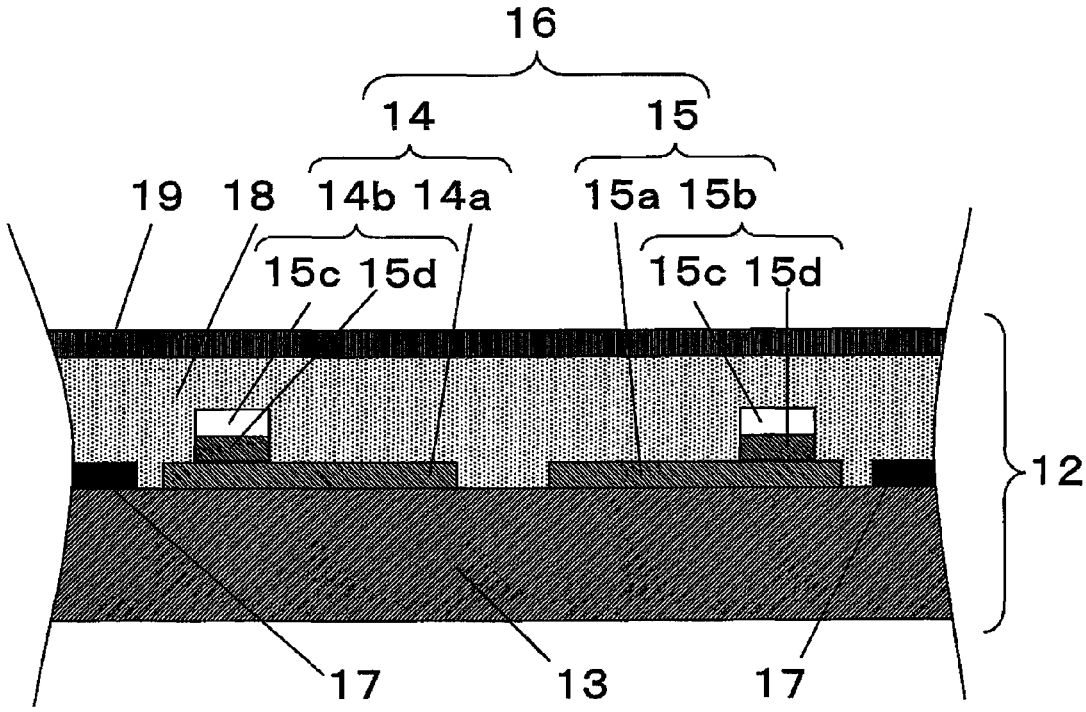
FIG. 2 is a sectional view of the front panel of the PDP shown in FIG. 1, illustrating the structure thereof.
Figure 3:
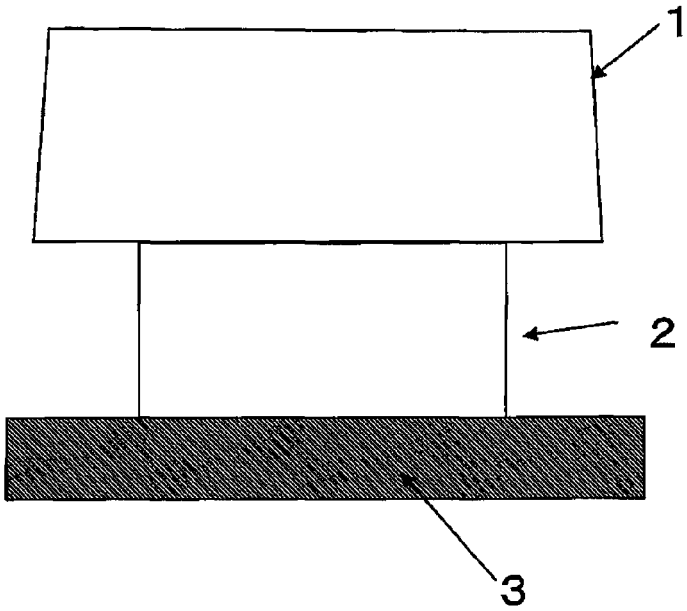
FIG. 3 is a schematic sectional view of an electrode formed by way of exposure and development according to a conventional process.
Figure 4:
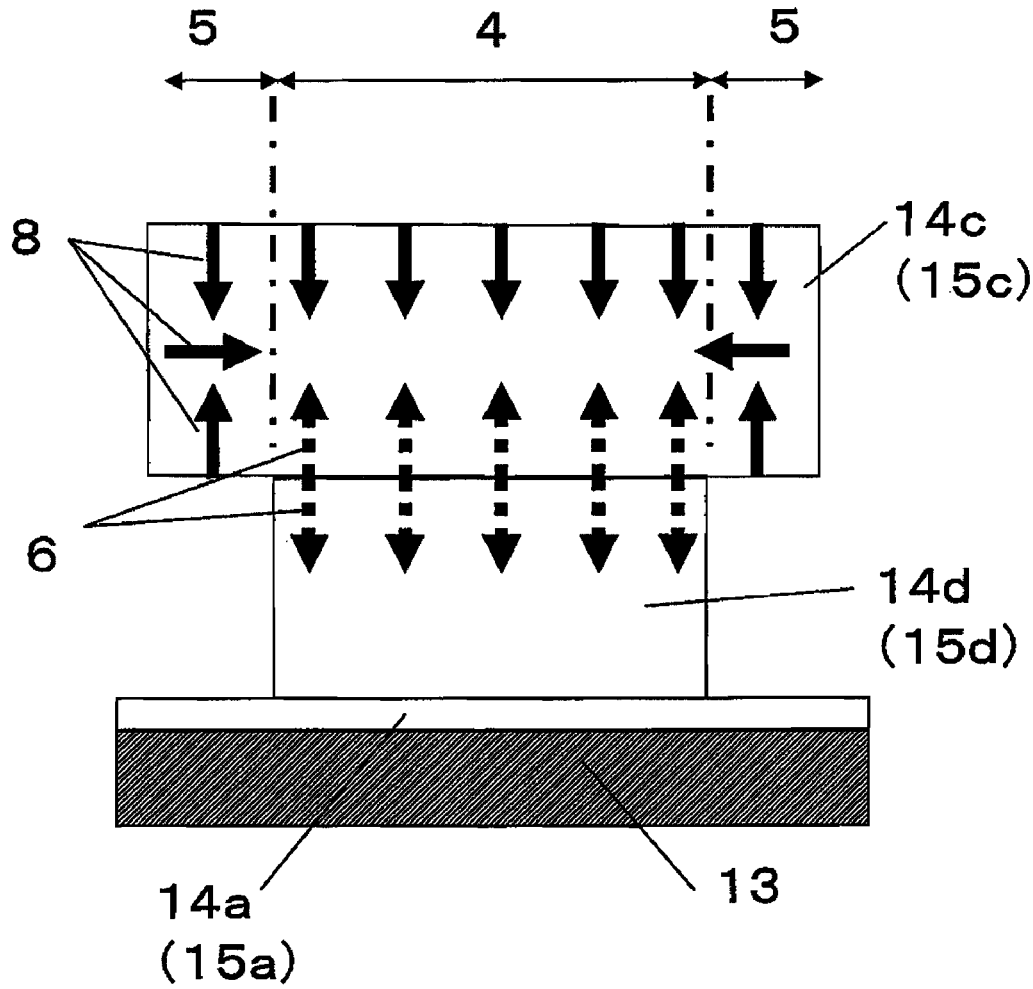
FIG. 4 is a schematic diagram illustrating the forces which act in the electrode formed by way of exposure and development according to the conventional process, while the electrode is being calcined.
Figure 5:
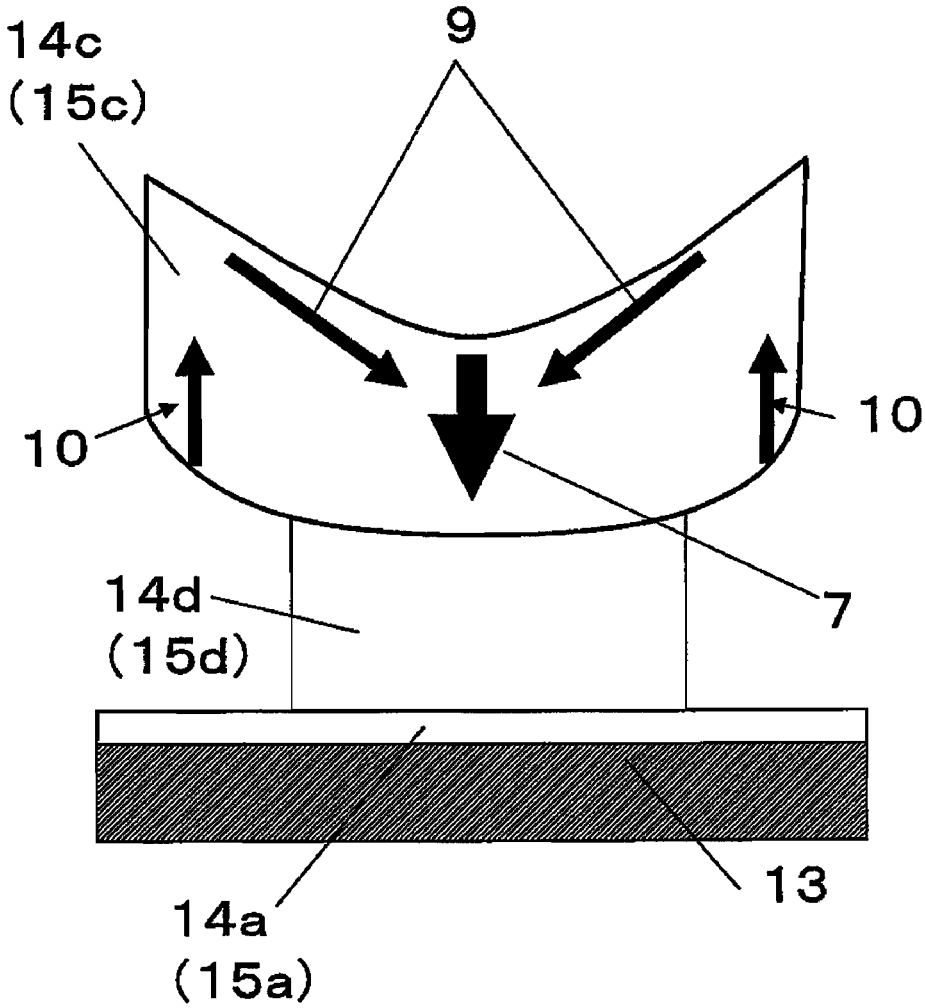
FIG. 5 is a schematic diagram illustrating the resultant force which acts in the electrode formed by way of exposure and development according to the conventional process, while the electrode is being calcined.

First, the structure of the PDP produced by the production method according to the embodiment of the present invention is described referring to FIGS. 1 and 2. FIG. 1 shows the perspective view of the PDP produced by the method of the present invention, illustrating the structure thereof; and FIG. 2 shows the cross-sectional view of the front panel of the PDP produced by the method of the present invention, illustrating the structure thereof. FIGS. 1 and 2 show parts of the PDP, respectively. As shown in FIG. 1, the PDP 100 includes a front panel 12 as a first substrate and a back panel 20 as a second substrate, which are disposed facing to each other and are airtight-sealed at their outer peripheral portions with a sealing member (not shown) such as glass frit or the like. Discharge gases such as neon (Ne), xenon (Xe), etc. are charged into a discharge space 26 inside the sealed PDP 100 under a pressure of 53,200 to 79,800 Pa.

A plural number of pairs of band-shaped display electrodes 16, each pair consisting of a scan electrode 14 and a sustain electrode 15, as first conductive films, and a plural number of black stripes (light-shielding layers) 17 are disposed in parallel to each other, on one surface of the front glass substrate 13 which constitutes the front panel 12. A dielectric layer 18 which functions as a capacitor is formed covering the surface of the front glass substrate 13 on which the display electrodes 16 and the black stripes 17 are formed. Further formed on the surface of the dielectric layer 18 is a protective layer 19 of magnesium oxide (MgO) or the like for protecting the electrodes.

Provided on the back glass substrate 21 which constitutes the back panel 20 are a plural number of band-shaped address electrodes 22 as the second conductive films which are disposed in parallel to each other and in a direction orthogonal to the scan electrodes 14 and the sustain electrode 15 on the front panel 12. These address electrodes 22 are covered with a base dielectric layer 23. Partition walls 24 with given heights high enough to section the discharge space 26 are formed on the surface of the base dielectric layer 23 and between the address electrodes 22. Fluorescent layers 25 which are excited by UV to emit red light, blue light and green light, respectively, are sequentially applied and formed for every one of the address electrodes 22 on the respective grooves between the partition walls 24. Discharge cells are formed at positions at which the scan electrodes 14 and the sustain electrodes 15 intersect the address electrodes 22; and the discharge cells, each of which has the fluorescent layers 25 of red, blue and green, laid in the direction of the display electrodes 16, constitute pixels for color display.

FIG. 2 shows the cross section of the front panel 12 which is turned upside down from the position thereof shown in FIG. 1, illustrating the structure thereof in detail. The front glass substrate 13 is manufactured by the float process or the like. The display electrodes 16 each consisting of the scan electrode 14 and the sustain electrode 15, and the black stripes 17 are formed by patterning.

The scan electrode 14 and the sustain electrode 15 comprise transparent electrodes 14*a* and 15*a* which are transparent conductive films formed of indium oxide (ITO), tin oxide (SnO2) or the like, and bus electrodes 14*b* and 15*b* formed on the transparent electrodes 14*a* and 15*a*, respectively. The bus electrodes 14*b* and 15*b* are formed in order to impart electric conductivity to the transparent electrodes 14*a* and 15*a* in their lengthwise directions. The bus electrodes shown in FIG. 2 have two-layered structures, and materials for the respective layers will be described later.

The dielectric layer 18 is so formed as to cover the transparent electrodes 14*a* and 15*a*, the bus electrodes 14*b* and 15*b*, and the black stripes 17 all of which are formed on the surface of the front glass substrate 13. The protective layer 19 is further formed on the dielectric layer 18.

Next, the method for producing the PDP 100 is described below.

First, the transparent electrodes 14*a* and 15*a* which constitute the scan electrodes 14 and the sustain electrodes 15, respectively, are formed on the front glass substrate 13. The transparent electrodes 14*a* and 15*a* are so formed as to have a predetermined pattern by a photolithographic method or the like. Then, the black stripes 17 are so formed as to have a predetermined pattern by the photolithographic method. The material for the black stripes is a paste containing a black pigment.

A paste of an electrode material for forming layers constituting the bus electrodes 14*b* and 15*b* is applied on the transparent electrodes 14*a* and 15*a* and is patterned by the photographic method and is further calcined to form the bus electrodes 14*b* and 15*b*. The material for the bus electrodes 14*b* and 15*b* is a paste of an electrode material containing conductive particles or a silver (Ag) material. In particular, the production method of the present invention is preferably employed to form the bus electrodes having two-layered structures as shown in FIG. 2. The method for forming the bus electrodes having the two-layered structures will be described later in detail.

Next, a dielectric glass paste is applied on the front glass substrate 13 by a die coating method or the like so as to cover the scan electrodes 14, the sustain electrodes 15 and the black stripes 17, and is then calcined to form the dielectric layer 18 with a thickness of from 5 μm to 50 μm. The dielectric glass paste is a coating composition which contains powdery dielectric glass frit, a binder and a solvent. The protective layer 19 with a thickness of 0.3 μm to 1 μm is further formed of magnesium oxide (MgO) on the dielectric layer 18 by a vacuum deposition process. The front panel 12 which includes the front glass substrate 13 having the predetermined constituents disposed on its surface is completed by the above-described steps.

The back panel 20 is formed as follows. First, a paste containing a silver (Ag) material is applied on the back glass substrate 21 to form a layer having a predetermined pattern for constituting the address electrodes 22. This pattern is formed by screen printing the paste, or by applying the paste on the entire surface of the glass substrate and patterning the layer by the photolithographic method. Then, the resulting layer is calcined at a given temperature to form the address electrodes 22.

Next, a dielectric glass paste is applied on the surface of the backing glass substrate 21 having the address electrodes 22 formed thereon, by the die coating method or the like, as if covering the address electrodes 22, to thereby form a dielectric paste layer. The dielectric paste layer is then calcined to form the base dielectric layer 23. The dielectric glass paste is a coating composition contains powdery dielectric glass frit, a binder and a solvent.

Next, a paste for forming the partition walls is applied to the surface of the base dielectric layer 23 and is patterned to give a predetermined configuration to form the partition wall layers, and is then calcined to form the partition walls 24. As the method for patterning the layer of the paste applied on the base dielectric layer 23, the photolithographic method or a sand blast method can be employed.

Next, a fluorescent paste containing a fluorescent material is applied to the parts of the surface of the base dielectric layer 23 between the adjacent partition walls 24 and to the side faces of the partition walls 24, and is then calcined to form the fluorescent layers 25. The predetermined constituents are formed on the back glass substrate 21 by the above-described steps, and thus, the back panel 20 is completed.

The front panel 12 which has the predetermined constituents provided thereon and the back panel 20 which has the predetermined constituents provided thereon are disposed facing to each other so that the display electrodes 16 and the address electrodes 22 can be orthogonal to each other; and both the panels are sealed at their peripheral portions with a sealing member. A discharge gas containing neon (Ne), xenon (Xe), etc. is charged into the discharge space 26 to thereby complete the PDP 100.

Figure 6:
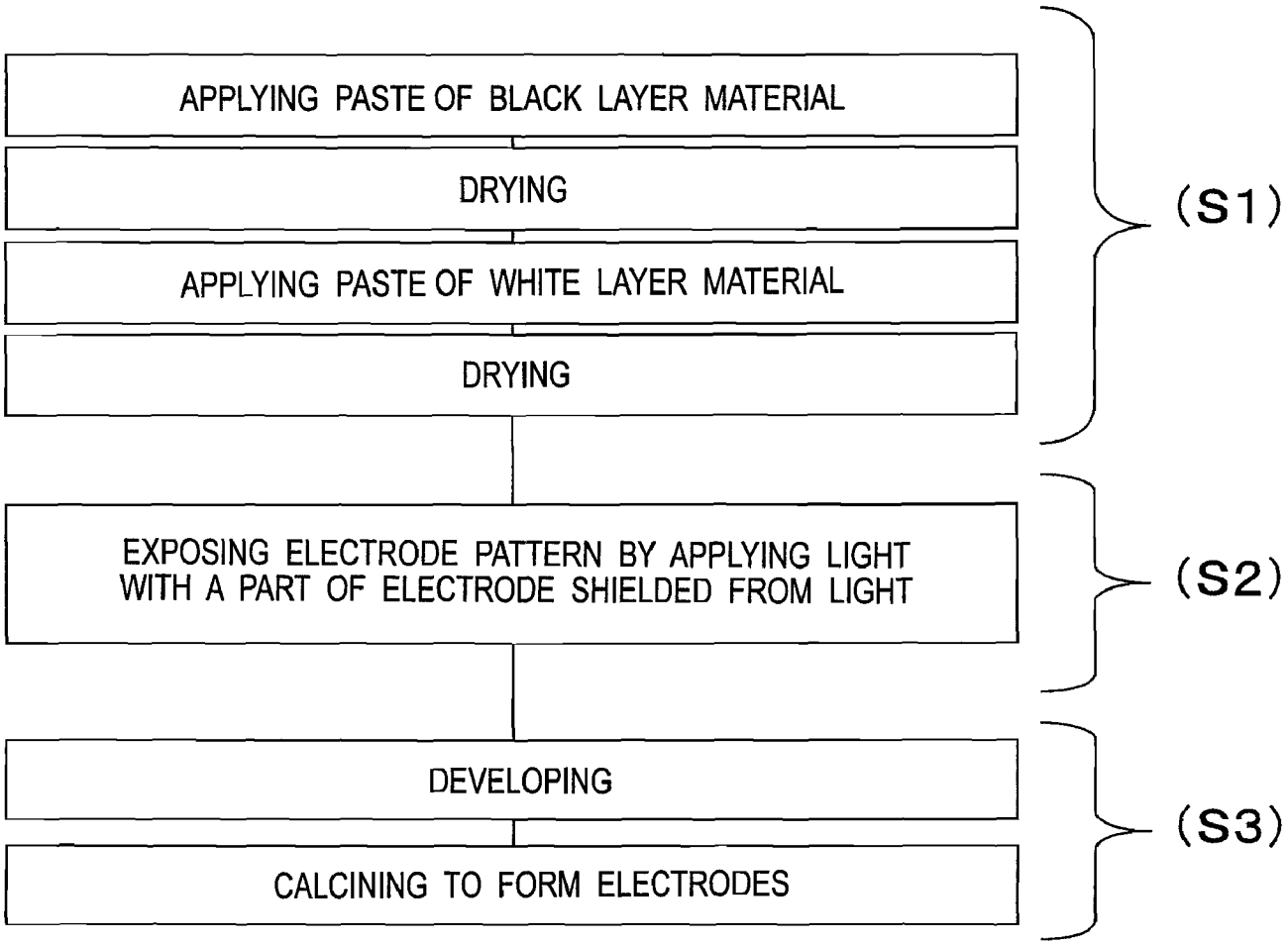
FIG. 6 shows a flowchart illustrating the steps of forming a bus electrode in the process for producing a PDP according to an embodiment of the present invention.
Figure 7A:
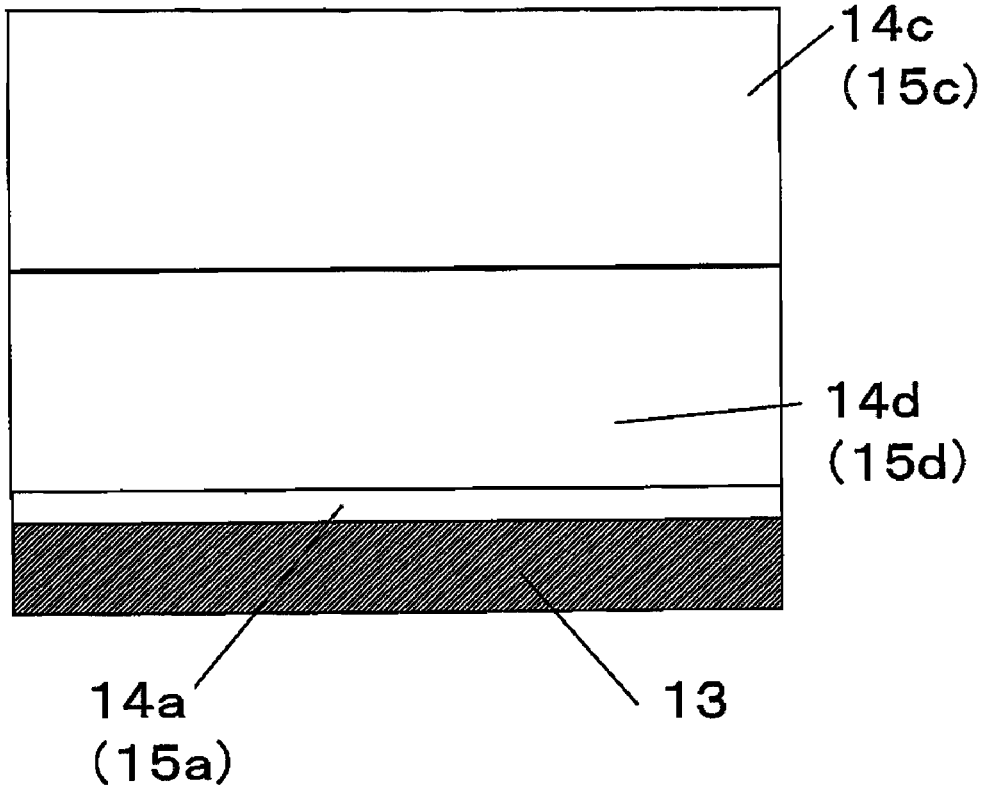
FIG. 7(*a*) is a sectional view illustrating Step S1 in the flowchart of FIG. 6.
Figure 7B:
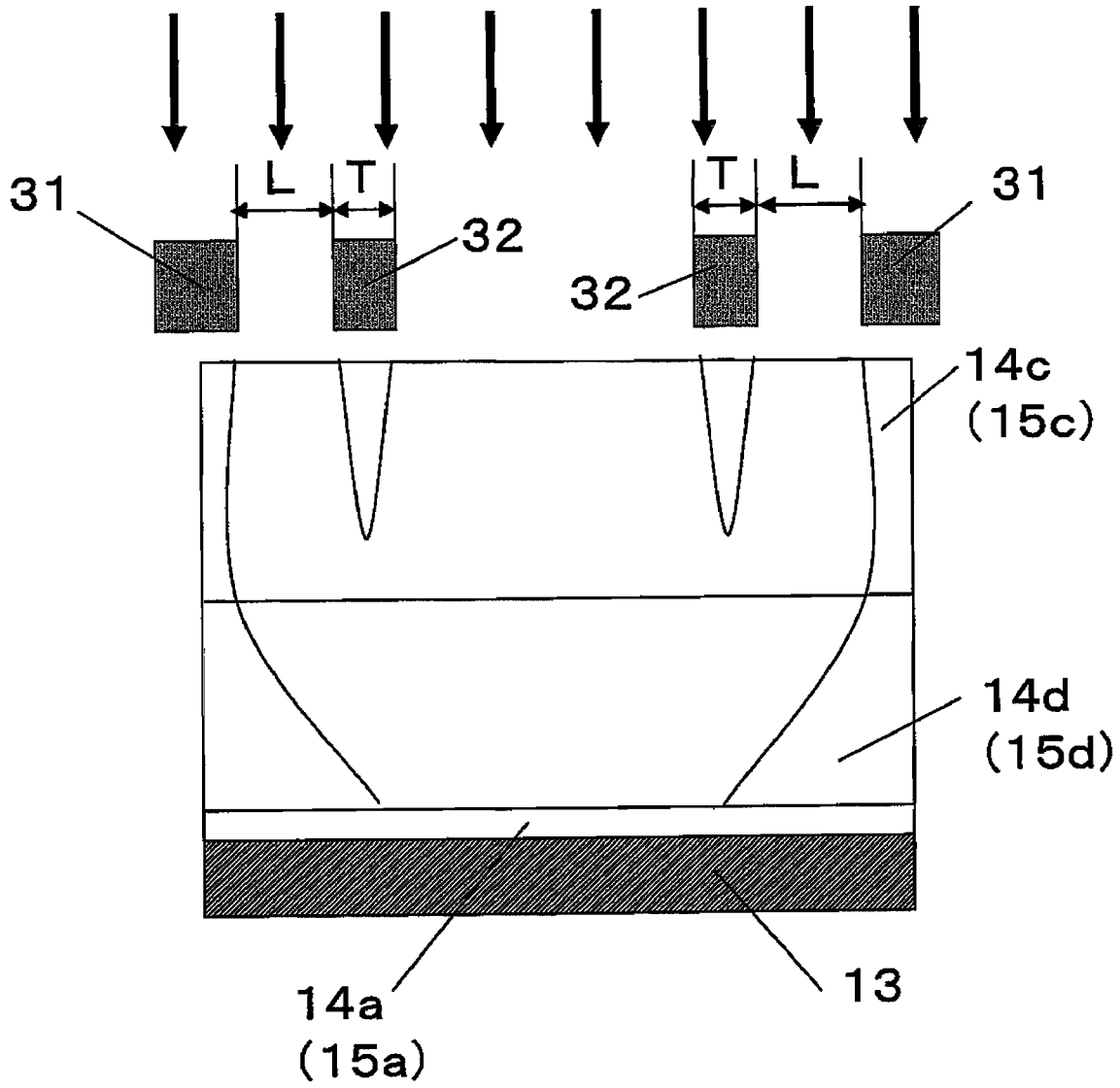
Figure 7C:
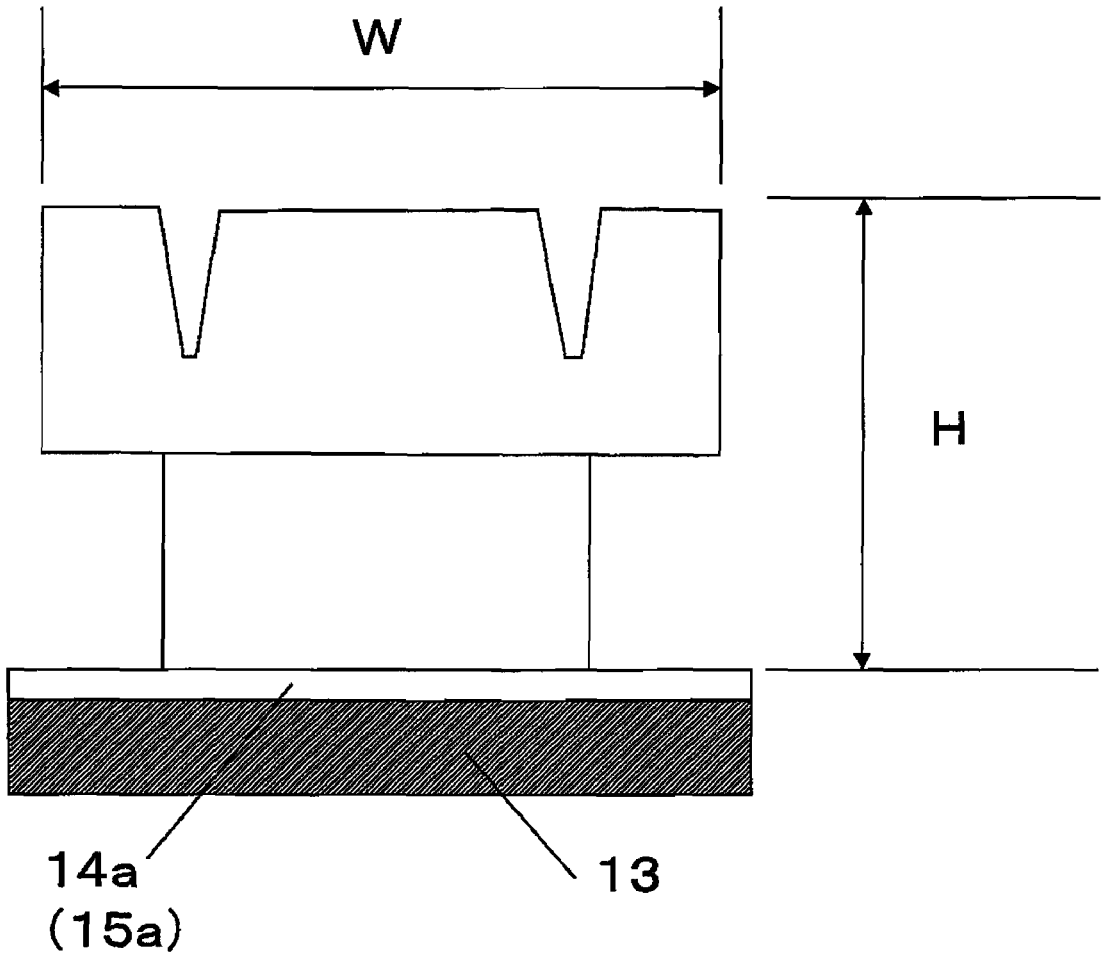
Figure 7D:
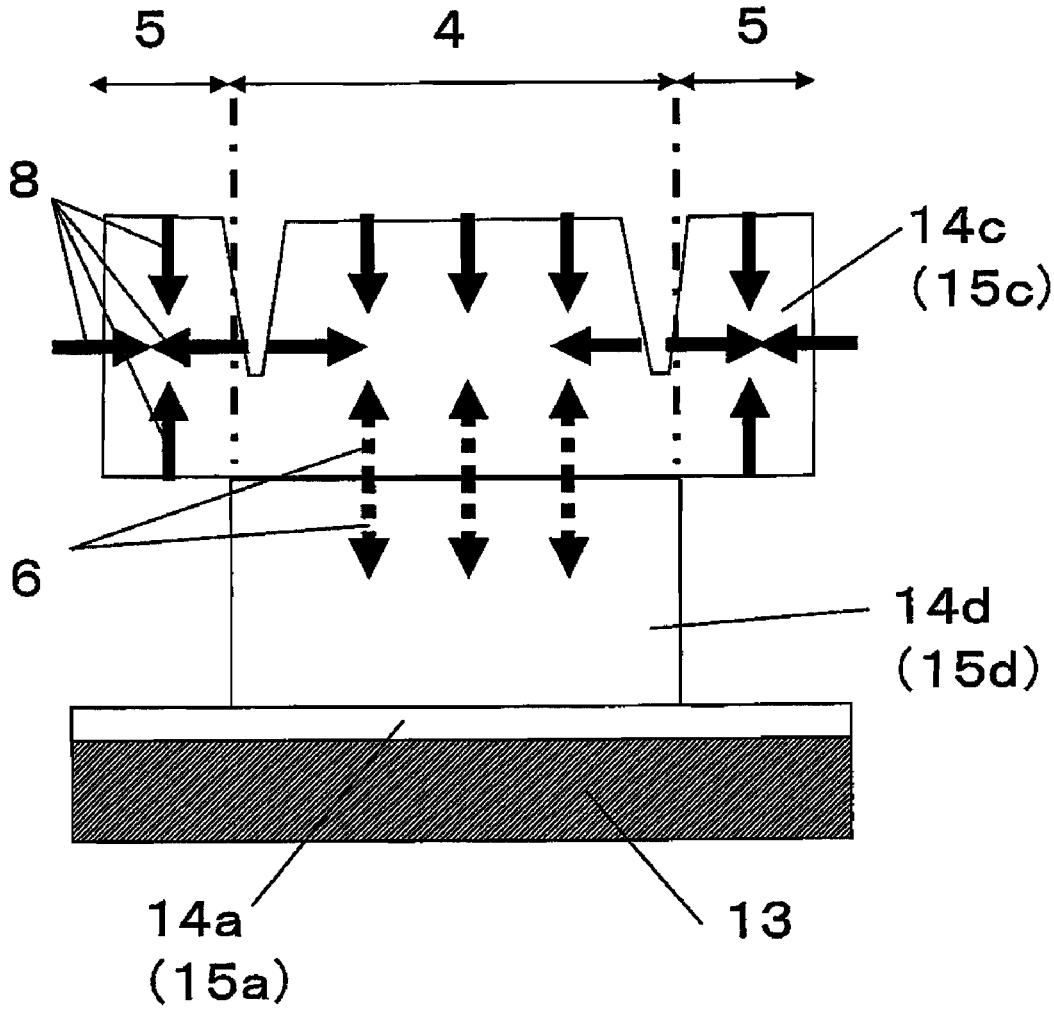
Figure 7E:
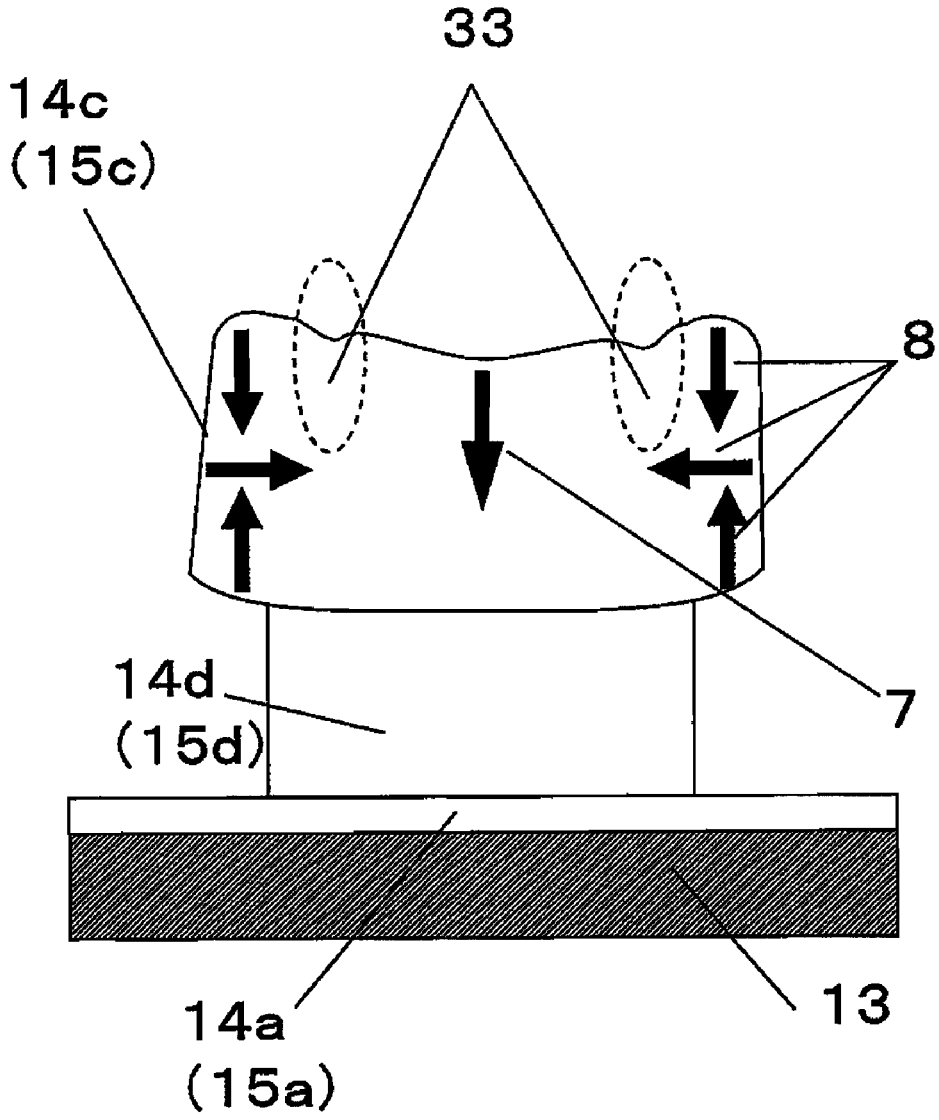

The process for manufacturing the plasma display panel has been schematically described as above. Next, the method for forming the bus electrodes 14*b* and 15*b* is described in more detail. In this embodiment, each of the bus electrodes has a two-layered structure consisting of a white layer and a black layer. FIG. 6 shows a flowchart illustrating the steps of forming such bus electrodes.

In Step S1, firstly, an electrode paste for the black layer and an electrode paste for the white layer are applied and dried to form the films of the electrode pastes, respectively. More specifically, the paste for the black layer is applied and dried; and then, the paste for the white layer is applied to the surface of the black layer and is then dried. Next, in Step S2, the surface of the films of the electrode pastes, formed in Step S1, is shielded from light, using a mask in accordance with a given pattern, and is then exposed to light, while a part of the surface of the portion of the film, at which the pattern is to be formed, (i.e., a part of the surface of the portion of the film where the electrode of the white layer is to be formed) is being shielded from light. In Step S3, the films of the electrode pastes, exposed in Step S2, are developed and are then calcined. After the completion of this step, the bus electrode is formed.

FIG. 7, consisting of FIGS. 7(*a*), 7(*b*), 7(*c*), 7(*d*) and 7(*e*), is sectional view showing the process corresponding to the steps of FIG. 6, wherein FIG. 7(*a*) shows the sectional view corresponding to Step S1; FIG. 7(*b*) shows the sectional view corresponding to Step S2; and FIGS. 7(*c*), 7(*d*) and 7(*e*) show the sectional views corresponding to Step S3, respectively.

FIG. 7(*a*) shows the films of the electrode pastes which are formed by applying the electrode pastes for the white layer 14*c* (or 15*d*) and the black layer 14*d* (or 15*d*) on the transparent electrode 14*a* (or 15*a*) formed on the surface of the front glass substrate 13, and drying the layers of the electrode pastes at 100° C. Any of the electrode pastes is a photosensitive paste. Preferably, the film of the electrode paste for forming the white layer 14*c* (or 15*d*) is so formed as to have a thickness of 3 μm to 50 μm after calcined, and the film of the electrode paste for forming the black layer 14*d* (or 15*d*) is so formed as to have a thickness of 0.5 μm to 5 μm after calcined.

The electrode pastes contain conductive particles, glass frits, ultrafine inorganic black particles, photosensitive resins, organic resins such as organic binders, polymerization initiators, monomers and organic solvents. The conductive particles are mainly contained in the white layer, and the ultrafine inorganic black particles are mainly contained in the black layer. As the case may be, the white layer and the black layer may contain the ultrafine inorganic black particles and the conductive particles, respectively, in so far as the addition of such components does not give adverse influences on the functions of these layers. Each of the electrode pastes is applied by roll coating or the like, and is then dried to evaporate off most of the organic solvent. Accordingly, the dried film of the electrode paste contains the conductive particles, the glass frit, the photosensitive resin, the organic resin (including a polymer obtained by polymerizing the monomer) such as the organic binder, and the monomer, excluding the evaporated organic solvent.

As the method for applying the electrode paste, the roll coating method, the die coating method, the spin coating method, the blade coating method or the like can be employed.

As described above, as each of the electrode pastes, there is used a mixture of ultrafine conductive particles such as silver (Ag) particles, glass frit comprising as main components bismuth oxide (Bi2O3), boron oxide (B2O3) and/or silicon oxide (SiO2), ultrafine inorganic black particles (only for the black layer), a polymerization initiator, a photosensitive resin, an organic resin such as an organic binder, a monomer and an organic solvent, which are all blended in the predetermined ratio. Hereinafter, the respective components are described.

As the ultrafine conductive particles, silver (Ag) particles with a particle diameter of 0.1 μm to 50 μm are preferably used. When the particle diameter of the silver particles is smaller than 0.1 μm, aggregation of the silver (Ag) particles tends to occur, which makes it difficult to keep constant the resistance of the resultant bus electrode 14*b* (or 15*b*). When the particle diameter of the silver particles exceeds 50 μm, the particle diameter of the silver (Ag) particles is larger than the height of the bus electrode 14*b* (or 15*b*), which makes it impossible to form the bus electrode 14*b* (or 15*b*) with a constant and uniform pattern. As the ultrafine conductive particles for the electrodes, there may be used particles of a metal selected from the metals having sufficient conductivity such as aluminum (Al), nickel (Ni), gold (Au), platinum (Pt), chromium (Cr), copper (Cu) and palladium (Pd) or particles of an alloy of some of these metals, other than the silver particles. Preferably, these ultrafine conductive particles are contained in the white layers in the embodiments of the present invention. Or otherwise, these ultrafine conductive particles may be contained in the black layers.

As the glass frit, it is preferable to use a glass frit having a low melting point, which contains as main component(s), bismuth oxide (Bi2O3), boron oxide (B2O3) and/or silicon oxide (SiO2). However, the glass frit is not limited to the above glass frits containing these materials as main components, and other glass frit may be used, in so far as it is a glass material capable of forming a desired shape of electrodes.

Next, the description is made on the ultrafine inorganic black particles. The ultrafine inorganic black particles are mainly contained in the black layers, or may be optionally contained in the white layers. As the ultrafine inorganic black particles, it is preferable to use particles of tricobalt tetraoxide (Co3O4). When the particles of tricobalt tetraoxide (Co3O4) are used as the ultrafine inorganic black particles, even the addition of a small amount thereof makes it possible to obtain a dense calcined film having sufficient blackness, so that sufficient contrast can be obtained from such a film with a thinner thickness. As a result, particularly with respect to the black layers, a calcined film which concurrently can satisfy sufficient interlayer conductivity (e.g., interlayer current passing between the transparent electrode and the white electrode) and sufficient blackness can be formed after the calcining step, without degrading the excellent adhesion to the substrate, the resolution power and the calcining ease, in each of the steps of drying, exposing, developing and calcining. Also, tricobalt tetraoxide (Co3O4) has high affinity with the polymerization initiator, the photosensitive resin, the organic components, the organic solvent or the like, and therefore, the use of tricobalt tetraoxide (Co3O4) in combination with the organic components or the organic solvent makes it possible to obtain an electrode paste excellent in storage stability.

It is desirable to use the ultrafine particles of tricobalt tetraoxide (Co3O4) with a particle diameter of not larger than 5 μm, preferably a particle diameter of from 0.05 μm to 5 μm. When the particle diameter is not larger than 5 μm, even the addition of a small amount thereof makes it possible to form a dense calcined film without degrading the adhesion. Accordingly, particularly with respect to the black layers, sufficient interlayer conductivity (or interlayer current passing between the transparent electrode and the white layer) and sufficient blackness concurrently can be satisfied.

It is also desirable to use the particles of tricobalt tetraoxide (Co3O4) having a specific surface area of from 1.0 m2/g to 20 m2/g. The reason therefor is that, when the specific surface area is smaller than 1.0 m2/g, the precision for forming a pattern by way of exposure tends to lower: that is, the linearity of line edges becomes poor, and it becomes hard to obtain a calcined film having sufficient blackness. On the other hand, when the specific surface area exceeds 20 m2/g, the amount of chipped particles during the development becomes larger due to such an excessively large specific surface area.

As the ultrafine inorganic black particles, a heat resistant black pigment may be used in combination with tricobalt tetraoxide (Co3O4) or may be used instead of tricobalt tetraoxide (Co3O4). The heat resistant black pigment is not particularly limited, in so far as it is an inorganic pigment excellent in heat resistance. In general, an oxide of a metal selected from a group consisting of chromium (Cr), cobalt (Co), nickel (Ni), iron (Fe), manganese (Mn) and ruthenium (Ru), or a composite oxide of metals selected therefrom is used as the heat resistant black pigment. Each of these materials may be used alone, or at least two selected therefrom may be used in combination.

The photosensitive resin is a resin which is crosslinked and insolubilized when illuminated with light. An example of such a resin is a carboxyl group-containing photosensitive resin which has an ethylenically unsaturated double bond. Specific examples of the photosensitive resin include, but are not limited to, the following carboxyl group-containing photosensitive resins: a carboxyl group-containing photosensitive resin obtained by adding an ethylenically unsaturated group as a pendant to a copolymer of an unsaturated carboxylic acid and a compound having an unsaturated double bond; a carboxyl group-containing photosensitive resin obtained by reacting a polybasic acid anhydride with a secondary hydroxyl group which is formed by reacting a copolymer of a compound having an epoxy group and an unsaturated double bond and a compound having an unsaturated double bond, with an unsaturated carboxylic acid; a carboxyl group-containing photosensitive resin obtained by reacting a copolymer of an acid anhdyride having an unsaturated double bond and a compound having an unsaturated double bond, with a compound having a hydroxyl group and an unsaturated double bond; a carboxyl group-containing photosensitive resin obtained by reacting a polybasic acid anhydride with a second hydroxyl group which is formed by reacting an epoxy compound with an unsaturated monocarboxylic acid; and a carboxyl group-containing photosensitive resin obtained by reacting a compound having an epoxy group and an unsaturated double bond with a carboxyl group-containing resin which is obtained by reacting a hydroxyl group-containing polymer with a polybasic acid anhydride. Each of these photosensitive resins may be used alone, or some of them may be used as a mixture.

Examples of the resin which acts as an organic binder include, but are not limited to, polyvinyl alcohol, polyvinyl butyral, a methacrylate polymer, an acrylate polymer, an acrylate-methacrylate copolymer, an α-methylstyrene polymer, a butyl methacylate resin and the like. Each of these organic binders may be used alone, or some of them may be used as a mixture.

The polymerization initiator is used to polymerize monomers described later. Examples of the polymerization initiator include, but are not limited to, benzoins and benzoin alkyl ethers such as benzoin, benzoin methyl ether, benzoin ethyl ether and benzoin isopropyl ether; acetophenones such as acetophenone, 2,2-dimethoxy-2-phenylacetophenone and 1,1-dichloroacetophenone; aminoacetophenones such as 2-methyl-1-[4-(methylthio)phenyl]-2-morphorinopropane-1-one and 2-benzyl-2-dimethylamino-1-(4-morphorinophenyl)-butanone-1; anthraquinones such as 2-methyanthraquinone, 2-ethylanthraquinone, 2-t-butylanthraquinone and 1-chloroanthraquinone; thioxanthones such as 2,4-dimethylthioxanthone, 2,4-diethylthioxanthone, 2-chlorothioxanthone and 2,4-diisopropylthioxanthone; ketals such as acetophenonedimethylketal and benzyldimethylketal; benzophenones such as benzophenone or xanthones; phosphine oxides such as (2,6-dimethoxybenzoyl)-2,4,4-pentylphosphine oxide, bis(2,4,6-trimethylbenzoyl)-phenylphosphine oxide, 2,4,6-trimethylbenzoyldiphenylphosphine oxide and ethyl-2,4,6-trimethylbenzoylphenylphosphinate; and various peroxides.

Examples of the monomer include, but are not limited to, 2-hydroxyethyl acrylate, 2-hydroxypropyl acrylate, diethyleneglycol diacrylate, triethyleneglycol acrylate, polyethyleneglycol diacrylate, polyurethane diacrylate, trimethylolpropane triacrylate, pentaerythritol triacrylate, pentaerythrytol tetracrylate, trimethylolpropaneethylene oxide-modified triacrylate, trimethylolpropanepropylene oxide-modified triacrylate, dipentaerythritol pentacrylate and dipentaerythritol hexacrylate; and methacrylates reactive with the above acrylates. Each of these monomers may be used alone to form a monopolymer; or some of these monomers may be used to form a copolymer.

Examples of the organic solvent include ketones such as methyl ethyl ketone and cyclohexanone; aromatic hydrocarbons such as toluene, xylene and tetramethylbenzene; glycol ethers such as cellosolve, methyl cellosolve, carbitol, methyl carbitol, butyl carbitol, propyleneglycol monomethylether, dipropyleneglycol monomethylether and triethyleneglycol-monoethylether; acetates such as ethyl acetate, butyl acetate, cellosolve acetate, butyl-cellosolve acetate, carbitol aceatate, butylcarbitol acetate and propyleneglycol monomethylether aceatate; alcohols such as ethanol, propanol, ethylene glycol, propylene glycol and terpineol; aliphatic hydrocarbons such as octane and decane; and petroleum-based solvents such as petroleum ether, petroleum naphtha and solvent naphtha. Each of these organic solvents may be used alone, or at least two selected therefrom may be used in combination.

The proportions of the components of the respective electrode pastes are appropriately selected. For example, the preferable proportions of the components of the electrode paste for forming the white layer are as follows:

0.5 to 200 parts by mass of the glass frit per 100 parts by mass of the ultrafine conductive particles, 10 to 80 parts by mass of the organic resin components such as the photosensitive resin and the organic binder per 100 parts by mass of the entire paste, 1 to 30 parts by mass of the polymerization initiator per 100 parts by mass of the resin components, 20 to 100 parts by mass of the monomer per 100 parts by mass of the resin components, and 1 to 30 parts by mass of the solvent per 100 parts by mass of the entire paste.

The preferable proportions of the components of the electrode paste for forming the black layer are as follows:

0.5 to 200 parts by mass of the glass frit per 100 parts by mass of the ultrafine inorganic black particles, 10 to 80 parts by mass of the organic resin components such as the photosensitive resin and the organic binder per 100 parts by mass of the entire paste, 1 to 30 parts by mass of the polymerization initiator per 100 parts by mass of the resin components, 20 to 100 parts by mass of the monomer per 100 parts by mass of the resin components, and 1 to 40 parts by mass of the solvent per 100 parts by mass of the entire paste.

Next, an exposure mask 31 is set on the surfaces of the dried films of the electrode pastes illustrated in FIG. 7(*a*), and simultaneously, light-shielding members 32 are set on the surfaces of portions of the films at which the electrode pattern is to be formed, as shown in FIG. 7(*b*). The above films of the electrode pastes are then exposed to light by applying light, while the above portion of the film which constitutes the surface of the electrode is being partially shielded from light. As a result, not only the portions of the films covered with the mask 31 but also some portions of the surface of the electrode pattern are left to be non-exposed. The exposure mask 31 and the light-shielding members 32 are peeled off, and then, the films of the electrode pastes in this state are developed using an aqueous alkaline solution to thereby remove the above non-exposed portions of the film. Then, the portions of the white layer and the black layer which correspond to the portions of the film covered with the mask 31 are removed after the development, as shown in FIG. 7(*c*). Thus, the electrode pattern is formed, and the electrode having recesses at its portions which correspond to the light-shielding members 32 is formed.

In this embodiment, two light-shielding members 32 are used and are disposed extending along a direction in parallel to the lengthwise direction of the electrode (i.e., a direction penetrating the drawing paper from its surface to its reverse). The recesses formed corresponding to the light-shielding members 32 form grooves which extend along the lengthwise direction of the electrode.

As seen in FIG. 7(*b*), the recesses are formed only in the white layer 14*c* (or 15*c*). In another embodiment, such recesses may have such depth that allows the recesses to penetrate the white layer 14*c* (or 15*c*) and reach the black layer 14*d* (or 15*d*). However, the depths of the recesses are not such that permits the recesses to penetrate the black layer 14 and reach the substrate. The depths of the recesses are preferably 10 to 80%, more preferably 15 to 50% of the total height of the white layer and the black layer, although such a depth varies depending upon the thickness of the white layer and the black layer. For example, the depth of the recesses is preferably from 1 μm to 8 μm, more preferably from 1.5 μm to 5 μm. When this depth is small, it becomes impossible to separate the thermal shrinkage of the center portion of the electrode in the widthwise direction from the thermal shrinkage of the end portions of the electrode in the widthwise direction during the calcining step. As a result, a force which pulls the white layer to the center portion thereof in the widthwise direction occurs in the surface portion of the white layer, and thus, the end portions of the white layer in the widthwise direction of the electrode project upward. When this depth is large, the resultant electrode is likely to chip, and defects in the electrode are more likely to be induced. In this regard, the depth of the recess means a distance in the thickness direction between the surface of the white layer (or the highest portion of the surface of the white layer, if the surface is not flat) and the deepest portion of the recess.

To form the recess having such a depth, it is preferable to take the following measure: as shown in FIG. 7(*b*), each of the light-shielding members 32 is so disposed that the interval L between the end portion of the electrode in the widthwise direction and the end portion of the light-shielding member in the widthwise direction, in other words, the distance L from the end portion of the electrode pattern in the widthwise direction to the end portion of the light-shielding member in the widthwise direction, satisfies the condition of 1 μm≦L≦10 μm; and the width T of the light-shielding member in the widthwise direction of the electrode satisfies the condition of 2 μm≦T≦10 μm. The interval L is usually a distance between the end portion (or side edge) of the exposure mask (which coincides with the end portion (or side edge) of the electrode) and the end portion (or side edge) of the light-shielding member in a direction parallel to the widthwise direction of the electrode. By selecting the position and the width of the light-shielding member as above, there can be formed a recess having a suitable depth which makes it possible to separate the thermal shrinkage of the center portion of the electrode in the widthwise direction from the thermal shrinkage of the end portions thereof during the calcining step to thereby control the thermal shrinkage, without forming any deep recess that cause the electrode to chip and to lose the function as the electrode.

In this figure, the two light-shielding members 32 which satisfy the conditions for L and T are disposed so that one electrode can have two recesses (or grooves) which extend along a direction in parallel to the lengthwise direction of the electrode. The number of the light-shielding members (or the number of recesses) is not necessarily limited to two, and thus, a single light-shielding member or three or more light-shielding members may be used. The light-shielding members 32 may be formed of the same material as that for the exposure mask 31 so as to be formed as a part of the mask. The light-shielding members 32 may be disposed in contact with the electrode paste or away from the electrode paste.

In the exposing step, it is possible to carry out contact exposure or non-contact exposure using the exposure mask (or negative mask) 31 having a predetermined electrode pattern. As a light source for exposure, a halogen lamp, a high-pressure mercury lamp, laser beams, a metal halide lamp, a black lamp or an electrodeless lamp may be used. The exposure amount is preferably from about 50 mJ/cm2 to about 1,000 mJ/cm2. The development is carried out using an aqueous alkaline metal solution such as an aqueous sodium carbonate solution, an aqueous sodium hydroxide solution, an aqueous calcium hydroxide solution or the like by a spraying method or a dipping method.

The configuration of the electrode found after the development is shown in FIG. 7(*c*), as the sectional view thereof taken along the widthwise direction. The height H of the electrode is preferably from 1 to 50 μm, and the width W thereof is preferably from 10 to 500 μm. When the height H of the electrode is lower than 1 μm, or when the width W of the electrode is smaller than 10 μm, the electric resistance of the electrode becomes higher after the calcining step, which makes it difficult for the electrode to obtain sufficient conductivity as the bus electrode. Again, when the width W of the electrode is smaller than 10 μm, the electrode is likely to chip while the recesses are being formed, and thus, failure in the electrode is more likely to occur. On the other hand, when the height H of the electrode exceeds 50 μm, or when the width W of the electrode exceeds 500 μm, difference in unevenness (or dents) formed between the bus electrode 14*b* (or 15*b*) and the front glass substrate 13 becomes too large after the calcining step, which makes it difficult to apply the paste of a dielectric material with an uniform thickness.

FIGS. 7(*d*) and 7(*e*) show the electrode found after the development, illustrating the states of thermal shrinkage which occur when the electrodes are calcined, for example, at a temperature of from about 400° C. to about 600° C. In the electrode shown in FIG. 7(*d*), the thermal shrinkage of the center portion of the electrode in the widthwise direction can be controlled separately from the thermal shrinkage of the end portions thereof during the calcining step, because the recesses are formed in the surface of the electrode. In the region 4 where the black layer is left to remain after the development, the interfacial forces of the white layer and the black layer offset each other, and the resultant force 7 directed to the glass substrate acts in the surface portion of the white layer. However, because of the presence of the recesses, this resultant force is not combined with the forces of shrinking the white layer inward which are caused in the end portions of the white layer in the widthwise direction of the electrode in the regions 5 at which parts of the black layer are removed during the development. Therefore, the forces of pulling the white layer toward the center portion thereof in the widthwise direction which forces are not caused in the surface portion of the white layer, unlike in the case of the electrodes formed by the conventional process. As a result, the end portions of the electrode in the widthwise direction do not turn upward but shrink toward the inside of the white layer, so that the end portions of the electrode in the widthwise direction are not projected upward, or are projected a little, even if so.

The recesses formed during the development are gradually filled with molten glass which results from the melting of the glass frit, when the conductive particles are bounded to one another. The recesses are almost perfectly filled after the completion of the final calcining to form a flat electrode surface, or to impart a slight dent to the electrode surface (refer to numeral 33 in FIG. 7(*e*)).

In this way, the recesses can be formed in the electrode surface after the development, by exposing to the light, the surfaces of the electrode paste layers which constitute the electrode pattern, while shielding the part thereof, and developing the exposed electrode paste layers to form the electrode pattern. As a result, the thermal shrinkage of the center portion of the electrode in the widthwise direction and the thermal shrinkage of the end portions thereof in the widthwise direction are controlled separately during the calcining step. Thus, there can be formed the electrode in which the flexure of the white layer and the projection of its end portions in the widthwise direction are inhibited, and simultaneously, a PDP having high performance for insulation and pressure-proof can be provided.

EXAMPLES

Next, Examples of the present invention are described below. In each of Examples and Comparative Example, 100 samples were fabricated under the following common conditions.

1) The configurations of the bus electrodes 14*b* and 15*b* as shown in FIG. 7(*c*) were selected; and the heights H of the electrodes were determined to be 10 μm, and the thickness of the black layers after the calcining step was determined to be 2 μm.

2) The electrode paste for the white layer was prepared by mixing silver (Ag) conductive particles with a particle diameter of from 200 nm to 1 μm, glass frit, resin components including a photosensitive resin and an organic binder, a polymerization initiator, a monomer and an organic solvent. The composition of the electrode paste was as follows:

Conductive particles: 100 parts by mass

Glass frit: 5 parts by mass per 100 parts by mass of the conductive particles

Resin components including the photosensitive resin and the organic binder: 15 parts by mass per 100 parts by mass of the entire paste Polymerization initiator: 2 parts by mass per 100 parts by mass of the resin components Monomer: 35 parts by mass per 100 parts by mass of the resin components Solvent: 10 parts by mass per 100 parts by mass of the entire paste 3) The electrode paste for the black layer was prepared by mixing the ultrafine inorganic black particles of tricobalt tetraoxide (Co3O4) which had a particle diameter of from 200 nm to 300 nm (0.2 μm to 0.3 μm) and a specific surface area of 4 m2/g to 16 m2/g, glass frit, resin components including a photosensitive resin and an organic binder, a polymerization initiator, a monomer and an organic solvent. The composition of the electrode paste was as follows:

Ultrafine inorganic black particles: 100 parts by mass

Glass frit: 50 parts by mass per 100 parts by mass of the above ultrafine inorganic black particles Resin components including the photosensitive resin and the organic binder: 30 parts by mass per 100 parts by mass of the entire paste Polymerization initiator: 2 parts by mass per 100 parts by mass of the resin components Monomer: 35 parts by mass per 100 parts by mass of the resin components Solvent: 10 parts by mass per 100 parts by mass of the entire paste 4) As the glass frit, glass frit containing bismuth oxide (Bi2O3), boron oxide (B2O3) and silicon oxide (SiO2) as main components was used.

5) As the photosensitive resin, a carboxyl group-containing photosensitive resin having an ethylenically unsaturated double bond (which was obtained by adding an ethylenically unsaturated group as a pendant to a copolymer of an unsaturated carboxylic acid and a compound having an unsaturated double bond) was used.

6) As the organic binder, polyvinyl alcohol was used.

7) As the polymerization initiator, 2-benzyl-2-dimethylamino-1-(4-morphorinophenyl)butane-1-one was used.

8) As the monomer, pentaerythritol triacrylate was used.

9) As the organic solvent, dipropyleneglycol-monomethylether was used.

Figure 8:
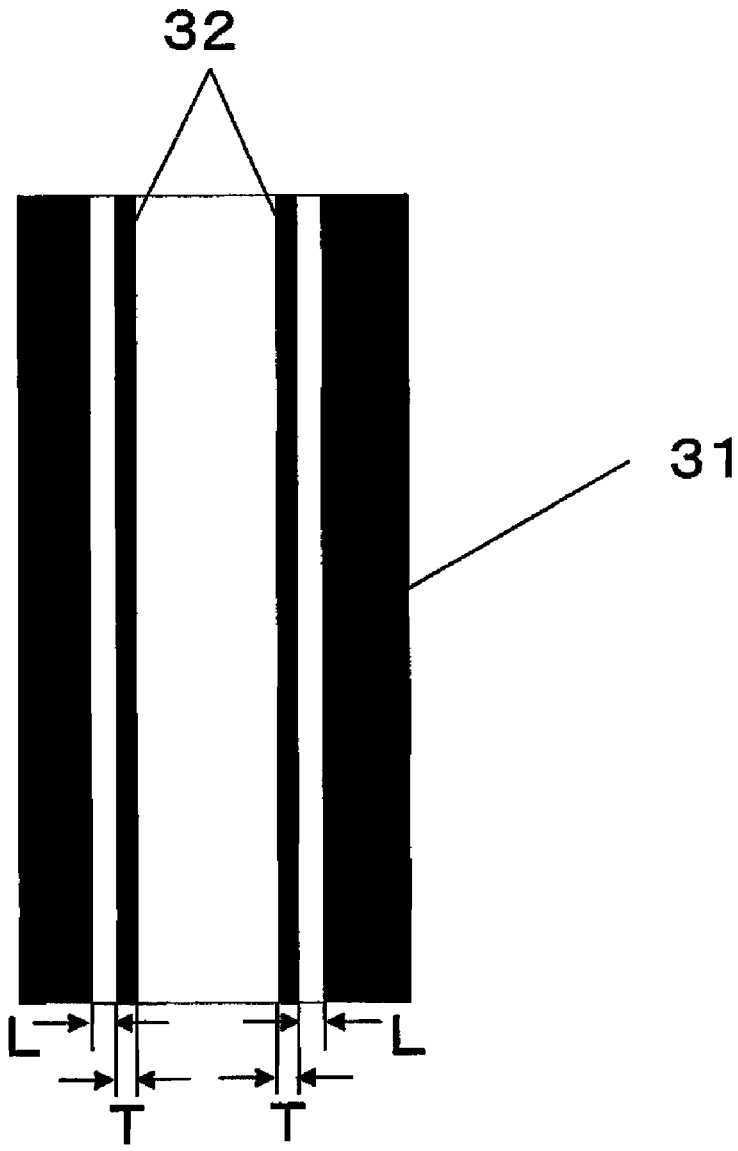
FIG. 8 is a plan view of light-shielding members used in the embodiment.

10) The light-shielding member 32 was a member as shown in FIG. 8 which continuously extended in a direction parallel to the lengthwise direction of the electrode. In FIG. 8, the element denoted by a numeral 31 is an exposure mask.

11) As the light source for exposure, a metal halide lamp was used, and the exposure amount was 200 mJ/cm2.

In each of Examples 1 and 2, each sample was fabricated under the following conditions: the interval L in the widthwise direction of the electrode between the end portion of the light-shielding member 32 and the end portion of the electrode pattern in the widthwise direction, and the width of the light-shielding member 32 in the widthwise direction of the electrode were varied, when the bus electrodes 14*b* and 15*b* were exposed to light. In Comparative Example, each sample was fabricated without using any light-shielding member.

Example 1

In Example 1, the width W of the electrode shown in FIG. 7(*c*) was 120 μm. The exposure was carried out while the distance L from the end portion of the light-shielding member in the widthwise direction of the electrode pattern was changed within a range of 0.5 to 18 μm, and while the width T of the light-shielding member in the widthwise direction of the electrode was changed within a range of 1 to 14 μm; and the electrode pattern was developed. After that, the electrodes were calcined at 600° C. to form the bus electrodes 14*b* and 15*b*. One hundred samples were fabricated for each one combination of T and L.

Next, a paste of a dielectric material was applied by the die coating method, to cover the bus electrodes 14*b* and 15*b*, and was dried at 100° C. and calcined at 600° C. to form a dielectric layer with a thickness of 50 μm. The dielectric material paste was prepared by mixing a glass frit which contained bismuth oxide (Bi2O3), boron oxide (B2O3) and silicon oxide (SiO2) as main components, ethyl cellulose as a binder component, and butylcarbitol acetate as an organic solvent. The mixing proportions of the respective components were as follows:

Glass frit: 60 parts by mass
Ethyl cellulose: 10 parts by mass
Organic solvent: 30 parts by mass Example 2

Electrodes were fabricated in the same manner as in Example 1, except that the width W of the electrode shown in FIG. 7(*c*) was set at 40 μm.

Comparative Example

Electrodes were fabricated in the same manner as in Examples 1 and 2, except that the surfaces of the electrode paste layers which constituted the electrode pattern were exposed to light without partially shielding the surfaces thereof.

Figure 9:
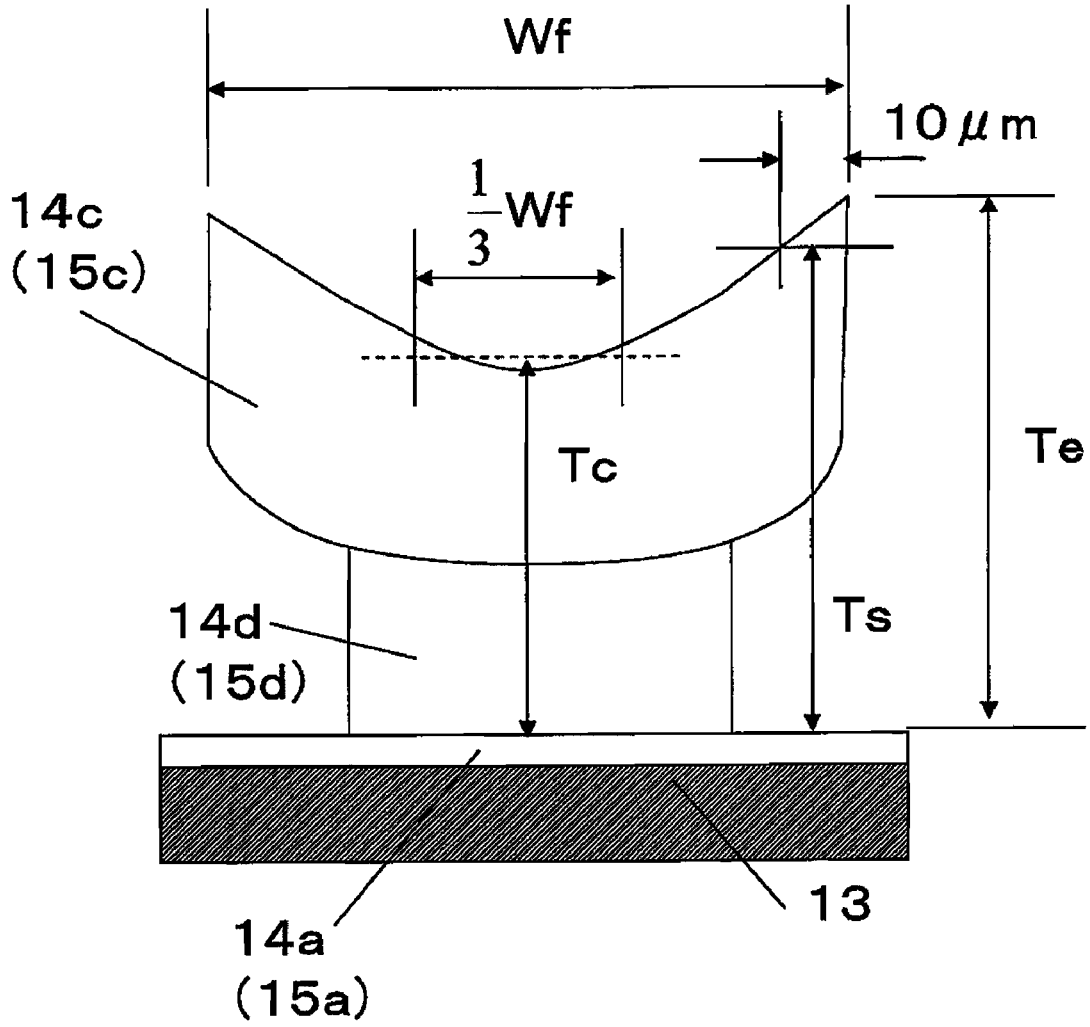
FIG. 9 is a sectional view of the electrode, illustrating the method of measuring the projected amounts of the electrodes.

The projected amount of each of the samples fabricated in Examples 1 and 2 and Comparative Example was measured, provided that the projected amount Ec was defined as a difference between Te and Tc, wherein, as shown in FIG. 9, Te is the height of the projection of the end portions of the electrode in the widthwise direction found after the calcining step (or the height of the higher end portion when the heights of both end portions were different); and Tc was an average height determined by equally dividing each of the widths Wf of the electrodes into three regions, and averaging the heights of the center regions (with a width of Wf/3) of the electrodes. The projected amount was determined as the maximum value of the projected amounts of 10 samples which were arbitrarily selected from the samples fabricated for every one combination of L and T. The results of the measurement in Example 1 are shown in Table 1; the results of the measurement in Example 2 are shown in Table 2; and results of the measurement in Comparative Example are shown in Table 3.

TABLE 1

| | | L (μm) | | | | | | | | | | |
|---|---|---|---|---|---|---|---|---|---|---|---|---|
| | | 0.5 | 1 | 2 | 4 | 6 | 8 | 10 | 12 | 14 | 16 | 18 |
| T (μm) | 1 | 3.6 | 3.6 | 3.6 | 3.7 | 3.6 | 3.7 | 3.7 | 3.7 | 3.6 | 3.7 | 3.7 |
| | 2 | Chipped | 1.5 | 1.6 | 1.8 | 1.9 | 2.0 | 2.0 | 2.5 | 2.8 | 3.5 | 3.6 |
| | 4 | Chipped | 1.4 | 1.5 | 1.7 | 1.8 | 1.9 | 2.0 | 2.5 | 2.8 | 3.5 | 3.7 |
| | 6 | Chipped | 1.3 | 1.3 | 1.5 | 1.8 | 1.9 | 2.0 | 2.4 | 2.7 | 3.5 | 3.7 |
| | 8 | Chipped | 1.2 | 1.2 | 1.4 | 1.7 | 1.8 | 1.9 | 2.3 | 2.7 | 3.4 | 3.6 |
| | 10 | Chipped | 1.1 | 1.1 | 1.3 | 1.6 | 1.8 | 1.8 | 2.2 | 2.7 | 3.4 | 3.7 |
| | 12 | Chipped | Chipped | Chipped | Chipped | Chipped | Chipped | Chipped | Chipped | Large Dent | Large Dent | Large Dent |
| | 14 | Chipped | Chipped | Chipped | Chipped | Chipped | Chipped | Chipped | Chipped | Large Dent | Large Dent | Large Dent |

TABLE 2

| | | L (μm) | | | | | | | | | | |
|---|---|---|---|---|---|---|---|---|---|---|---|---|
| | | 0.5 | 1 | 2 | 4 | 6 | 8 | 10 | 12 | 14 | 16 | 18 |
| T (μm) | 1 | 3.6 | 3.6 | 3.6 | 3.7 | 3.7 | 3.7 | 3.7 | 3.7 | 3.7 | 3.7 | 3.7 |
| | 2 | Chipped | 1.5 | 1.5 | 1.8 | 1.9 | 2.0 | 2.0 | 2.5 | 2.8 | 3.5 | 3.7 |
| | 4 | Chipped | 1.4 | 1.4 | 1.6 | 1.9 | 1.9 | 2.0 | 2.5 | 2.8 | 3.5 | 3.7 |
| | 6 | Chipped | 1.3 | 1.3 | 1.5 | 1.8 | 1.9 | 1.9 | 2.3 | 2.7 | 3.4 | 3.7 |
| | 8 | Chipped | 1.2 | 1.2 | 1.4 | 1.7 | 1.8 | 1.9 | 2.3 | 2.7 | 3.4 | 3.7 |
| | 10 | Chipped | 1.1 | 1.1 | 1.3 | 1.6 | 1.8 | 1.8 | 2.2 | 2.7 | 3.4 | 3.7 |
| | 12 | Chipped | Chipped | Chipped | Chipped | Chipped | Chipped | Chipped | Chipped | Large Dent | Large Dent | Large Dent |

TABLE 2-continued

| | L (μm) | | | | | | | | | | |
|---|---|---|---|---|---|---|---|---|---|---|---|
| | 0.5 | 1 | 2 | 4 | 6 | 8 | 10 | 12 | 14 | 16 | 18 |
| 14 | Chipped | Chipped | Chipped | Chipped | Chipped | Chipped | Chipped | Chipped | Large Dent | Large Dent | Large Dent |

TABLE 3

| | | L (μm) 0 (No Light-Shielding Member Used) |
|---|---|---|
| T (μm) | 0 (No Light-Shielding Member Used) | 3.7 |

The term of "chipped" seen in Tables 1 and 2 means that the bus electrode was chipped while the dielectric layer was being formed; and the term of "large dent" means that the recess corresponding to the light-shielding member was not sufficiently filled with the molten glass frit to leave a large dent to remain in the surface of the electrode.

As is understood from Tables 1 to 3, the projected amounts of the electrodes fabricated by the process of the present invention can be reduced in comparison with the projected amounts of the electrodes fabricated by the conventional process, because of the effect of the recesses formed by partially shielding the electrode paste layers from light during the exposure. Particularly, an excellent effect of a projected amount of 2 μm or less was obtained, when the interval L between the end portion of the electrode pattern in the widthwise direction and the end portion of the light-shielding member in the widthwise direction, and the width T of the light-shielding member in the widthwise direction of the electrode satisfied the following conditions:

$$1\mu m \leqq L \leqq 10\mu m, \text{ and}$$

$$2\mu m \leqq T \leqq 10\mu m.$$

Next, the samples of Examples 1 and 2 and Comparative Example were compared with respect to a breakdown defective fraction, by conducting lighting tests while passing a current of average 50 mA, assuming actual lighting. The results are shown in Table 4.

TABLE 4

| Sample | Ec (μm) | Breakdown Defective Fraction (%) |
|---|---|---|
| (Comparative Example) | 3.7 | 1.70 |
| Examples 1-2 | 3.5 | 1.65 |
| | 3.4 | 1.60 |
| | 2.5 | 1.21 |
| | 2.2 | 1.15 |
| | 1.9 | 0.80 |
| | 1.5 | 0.60 |
| | 1.1 | 0.50 |

In Table 4, the sample of which the projected amount Ec was 3.5 was equivalent to a sample of Example 1 in which L was 16 μm and T, 6 μm; the sample of which the projected amount Ec was 3.4 was equivalent to a sample of Example 1 in which L was 16 μm and T, 10 μm; the sample of which the projected amount Ec was 2.5 was equivalent to a sample of Example 1 in which L was 12 μm and T, 4 μm; the sample of which the projected amount Ec was 2.2 was equivalent to a sample of Example 1 in which L was 12 μm and T, 10 μm; the sample of which the projected amount Ec was 1.9 was equivalent to a sample of Example 1 in which L was 10 μm and T, 8 μm; the sample of which the projected amount Ec was 1.5 was equivalent to a sample of Example 1 in which L was 4 μm and T, 6 μm; and the sample of which the projected amount Ec was 1.1 was equivalent to a sample of Example 1 in which L was 1 μm and T, 10 μm.

As is understood from Table 4, the projected amounts of the electrodes fabricated by the process of the present invention could be reduced due to the effect of the recesses formed by the partial shielding during the exposure, with the result that the breakdown defective fraction could be decreased. Particularly, an excellent result of a percentage of 1.2% or less in the breakdown defective fraction was obtained from the samples of which the projected amounts were 2 μm or less, fabricated under the following conditions for the interval L and the width T:

$$1\mu m \leqq L \leqq 10\mu m, \text{ and}$$

$$2\mu m \leqq T \leqq 10\mu m.$$

Figure 10:
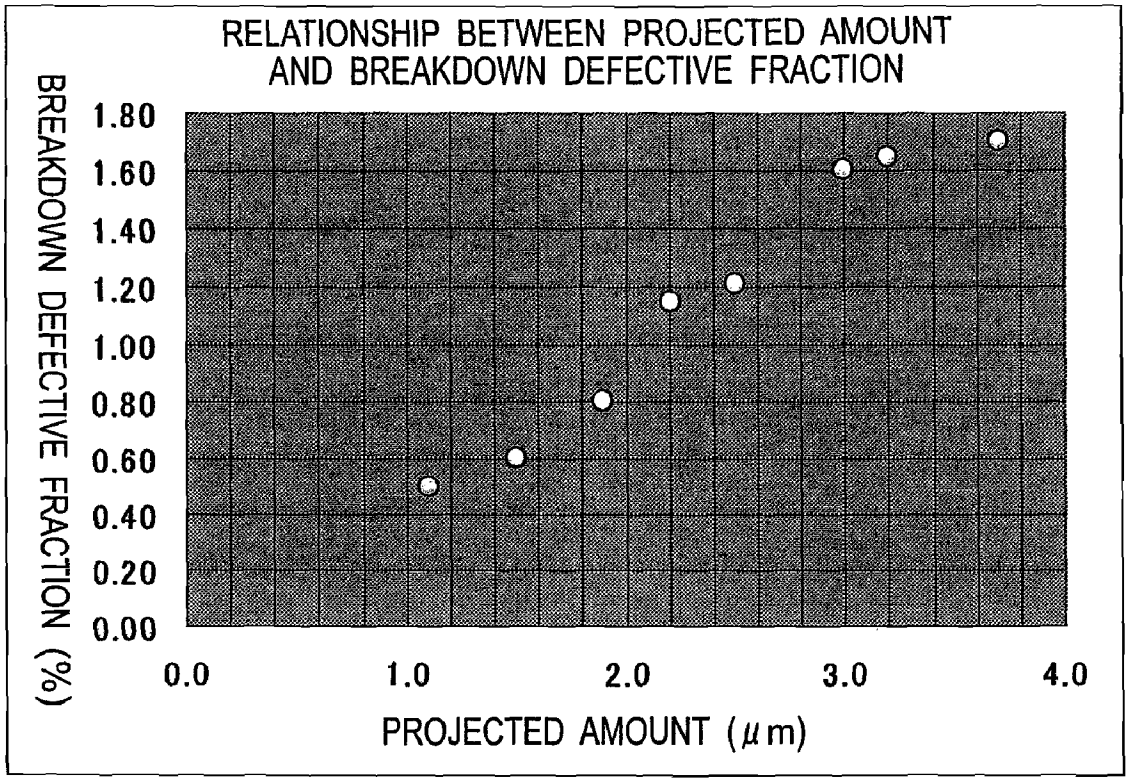
FIG. 10 is a graph indicating a relationship between the projected amount of the electrode and the breakdown defective fraction.

This result is very excellent in comparison with the breakdown defective fraction of 1.7%, obtained from the electrode of Comparative Example. The relationship between the projected amount and the breakdown defective fraction is shown in the graph on FIG. 10.

In each of the samples of Examples and Comparative Example, the height Ts at a position 10 μm inward in the widthwise direction of the electrode, from the highest position (the higher one of both end portions) of the projected end portions of the electrode in the widthwise direction found after the calcining step as shown in FIG. 9, was measured. The difference between Ts and Tc was defined as Tg, and Tg of each of the samples fabricated in Examples 1 and 2 and Comparative Example was measured. As Tg, a maximum value was selected from the values Tg of 10 samples randomly selected from the samples fabricated for every one combination of L and T. The results of the measurement of Example 1 are shown in Table 5; the results of the measurement of Example 2 are shown in Table 6; and the results of the measurement of Comparative Example are shown in Table 7.

TABLE 5

| | | L (μm) | | | | | | | | | | |
|---|---|---|---|---|---|---|---|---|---|---|---|---|
| | | 0.5 | 1 | 2 | 4 | 6 | 8 | 10 | 12 | 14 | 16 | 18 |
| T (μm) | 1 | 3.1 | 3.1 | 3.1 | 3.2 | 3.2 | 3.2 | 3.2 | 3.2 | 3.2 | 3.2 | 3.2 |
| | 2 | Chipped | 1.2 | 1.2 | 1.2 | 1.2 | 1.4 | 1.4 | 2.1 | 2.2 | 3.0 | 3.2 |
| | 4 | Chipped | 0.6 | 0.6 | 0.6 | 0.6 | 0.7 | 0.8 | 2.1 | 2.2 | 3.0 | 3.2 |
| | 6 | Chipped | 0.0 | 0.0 | 0.0 | 0.0 | 0.1 | 0.2 | 2.0 | 2.1 | 2.9 | 3.2 |
| | 8 | Chipped | −1.4 | −1.4 | −1.4 | −1.4 | −1.3 | −1.2 | 2.0 | 2.1 | 2.9 | 3.2 |
| | 10 | Chipped | −0.2 | −0.2 | −0.2 | −0.2 | −0.3 | −0.4 | 2.0 | 2.1 | 2.9 | 3.2 |
| | 12 | Chipped | Chipped | Chipped | Chipped | Chipped | Chipped | Chipped | Chipped | Large Dent | Large Dent | Large Dent |
| | 14 | Chipped | Chipped | Chipped | Chipped | Chipped | Chipped | Chipped | Chipped | Large Dent | Large Dent | Large Dent |

TABLE 6

| | | L | | | | | | | | | | |
|---|---|---|---|---|---|---|---|---|---|---|---|---|
| | | 0.5 | 1 | 2 | 4 | 6 | 8 | 10 | 12 | 14 | 16 | 18 |
| T (μm) | 1 | 3.1 | 3.1 | 3.1 | 3.1 | 3.2 | 3.2 | 3.2 | 3.2 | 3.2 | 3.2 | 3.2 |
| | 2 | Chipped | 1.2 | 1.2 | 1.2 | 1.2 | 1.3 | 1.4 | 2.1 | 2.2 | 3.0 | 3.2 |
| | 4 | Chipped | 0.6 | 0.6 | 0.6 | 0.7 | 0.7 | 0.9 | 2.1 | 2.1 | 3.0 | 3.2 |
| | 6 | Chipped | 0.0 | 0.0 | 0.0 | 0.1 | 0.1 | 0.2 | 2.1 | 2.1 | 3.0 | 3.2 |
| | 8 | Chipped | −1.4 | −1.4 | −1.4 | −1.3 | −1.3 | −1.1 | 2.0 | 2.1 | 2.9 | 3.2 |
| | 10 | Chipped | −0.2 | −0.2 | −0.2 | −0.3 | −0.3 | −0.4 | 2.0 | 2.1 | 2.9 | 3.2 |
| | 12 | Chipped | Chipped | Chipped | Chipped | Chipped | Chipped | Chipped | Chipped | Large Dent | Large Dent | Large Dent |
| | 14 | Chipped | Chipped | Chipped | Chipped | Chipped | Chipped | Chipped | Chipped | Large Dent | Large Dent | Large Dent |

TABLE 7

| | L(μm) 0 (No Light-Shielding Member Used) |
|---|---|
| T (μm) | 0 (No Light-Shielding Member Used) |
| | 3.2 |

As is understood from Tables 5 to 7, Tg of each of the samples fabricated by the process of the present invention could be decreased due to the effect of the recesses formed by the partial shielding during the exposure, as compared with Tg of the conventional electrodes. The achievement of decrease in Tg means that the height of the electrode from the center portion of the electrode to the end portion thereof in the widthwise direction can be uniformed. In comparison with the samples of Comparative Example in which the projected amounts were large and in which increases in the heights of the electrodes from the center portions of the electrodes to the end portions thereof in the widthwise directions were large, the heights of the electrodes at positions nearer to the end portions of the electrodes in the widthwise directions could be more close to the heights of the center portions of the electrodes in the widthwise directions, because of the effect of the recesses formed by the partial shielding during the exposure. As described above, by forming an electrode having a more constant height in the widthwise direction, the discharge surface can be uniformed, so that more stable discharge characteristics can be obtained.

Further, in the samples in which the intervals L between the end portions of the electrode patterns in the widthwise directions and the end portions of the light-shielding members in the widthwise directions fulfilled 1 μm≦L≦10 μm, and in which the widths T of the light-shielding members in the widthwise directions of the electrodes fulfilled 2 μm≦T≦10 μm, it is possible to decrease the values of Tg to very small values (2 μm or less), and thus, it is found that the electrodes having smaller variability in the heights in the widthwise directions of the electrodes were formed.

The method for producing a PDP, according to the present invention, makes it possible to reduce the projection amounts of the end portions of electrodes which have two-layered structures, in the widthwise directions of the electrodes, because of the recesses which are formed in the electrodes by the partial shielding of the electrodes during exposure, in the course of the collective exposure and development of the electrodes having the two-layered structures. Because of the reduction of the projection amounts, breakdown defective (or breakdown failure) can be decreased. Thus, PDPs having high performance for insulation and pressure-proof can be manufactured at a higher yield. Therefore, PDPs manufactured by the method of the present invention can satisfy the demands for high definition and lower cost and thus are useful.

The invention claimed is:

1. A method for producing a plasma display panel, comprising:

forming a first layer by applying a first material for a lower electrode layer on a glass substrate;

forming a second layer by applying a second material for an upper electrode layer on the surface of the first layer; and exposing to light a first part of the surface of the second layer, while shielding from light using a light-shielding member a second part of the surface of the second layer, and while shielding from light using a mask a third part of the surface of the second layer for portions of the first and second layers that are not to be formed into an electrode;

developing such exposed portions of the first and the second layers to form an electrode, wherein a dimension T of the light-shielding member for shielding said second part of the surface in a direction parallel to a widthwise direction of the electrode fulfills 2 μm≦T≦10 μm and wherein the light shielding member is located such that an interval L between an end portion of the electrode in the widthwise direction, faulted after the exposure, and the end portion of the light-shielding member in the widthwise direction fulfills 1 μm≦L≦10 μm.

2. The method according to claim 1, wherein said light-shielding member extends in a direction parallel to a lengthwise direction of the electrode.

3. The method according to claim 1, wherein the electrode is a bus electrode which has two layers, that are a black layer located on a lower side and a white layer located on an upper side.

4. The method according to claim 1, wherein one of the layers of the electrode is formed of an electrode material which comprises, as ultrafine conductive particles, at least one kind of particles of a metal selected from a group consisting of silver (Ag), aluminum (Al), nickel (Ni), gold (Au), platinum (Pt), chromium (Cr), copper (Cu) and palladium (Pd) or of an alloy of these metals.

5. The method according to claim 1, wherein one of the layers of the electrode is formed of an electrode material which contains, as a black component, ultrafine particles of tricobalt tetraoxide ($Co_3O_4$).

6. The method according to claim 1, wherein one of the layers of the electrode is formed of an electrode material which contains, as a black component, an oxide of at least one metal selected from a group consisting of chromium (Cr), cobalt (Co), nickel (Ni), iron (Fe), manganese (Mn) and ruthenium (Ru).

7. The method according to claim 1, wherein the mask and the light shielding member are set simultaneously.

8. The method according to claim 1, wherein the light shielding member is formed as part of the mask.

9. The method according to claim 1, wherein said exposing comprises exposing to light the first part of the surface of the second layer, while shielding from light, using a plurality of light-shielding members; a respective plurality of second parts of the surface of the second layer, and while shielding from light using a mask a third part of the surface of the second layer for portions of the first and second layers that are not to be formed into an electrode.

10. A method for producing a plasma display panel, comprising:

forming a first layer by applying a first material for a lower electrode layer on a glass substrate;

forming a second layer by applying a second material for an upper electrode layer on the surface of the first layer; and exposing to light a first part of the surface of the second layer, while shielding from light using a light-shielding member a second part of the surface of the second layer, and while shielding from light using a mask a third part of the surface of the second layer for portions of the first and second layers that are not to be formed into an electrode;

developing such exposed portions of the first and the second layers to form an electrode, wherein a dimension T of the light-shielding member for shielding said second part of the surface in a direction parallel to a widthwise direction of the electrode fulfills 2 μm≦T≦10 μm, and wherein a distance L between an end portion of the mask in the widthwise direction and the end portion of the light-shielding member in the widthwise direction fulfills 1 μm≦L≦10 μm.

11. The method according to claim 10, wherein said light-shielding member extends in a direction parallel to a lengthwise direction of the electrode.

12. The method according to claim 10, wherein said electrode is a bus electrode which has two layers that are a black layer located on a lower side and a white layer located on an upper side.

13. The method according to claim 10, wherein one of the layers of the electrode is formed of an electrode material which comprises, as ultrafine conductive particles, at least one kind of particles of a metal selected from a group consisting of silver (Ag), aluminum (Al), nickel (Ni), gold (Au), platinum (Pt), chromium (Cr), copper (Cu) and palladium (Pd) or of an alloy of these metals.

14. The method according to claim 10, wherein one of the layers of the electrode is formed of an electrode material which contains, as a black component, ultrafine particles of tricobalt tetraoxide ($Co_3O_4$).

15. The method according to claim 10, wherein one of the layers of the electrode is formed of an electrode material which contains, as a black component, an oxide of at least one metal selected from a group consisting of chromium (Cr), cobalt (Co), nickel (Ni), iron (Fe), manganese (Mn) and ruthenium (Ru).

16. The method according to claim 10, wherein the mask and the light shielding member are set simultaneously.

17. The method according to claim 10, wherein the light shielding member is formed as part of the mask.

18. The method according to claim 10, wherein said exposing comprises exposing to light the first part of the surface of the second layer, while shielding from light, using a plurality of light-shielding members, a respective plurality of second parts of the surface of the second layer, and while shielding from light using a mask a third part of the surface of the second layer for portions of the first and second layers that are not to be formed into an electrode.

* * * * *

UNITED STATES PATENT AND TRADEMARK OFFICE

CERTIFICATE OF CORRECTION

PATENT NO. : 7,857,675 B2
APPLICATION NO. : 12/057024
DATED : December 28, 2010
INVENTOR(S) : Akihiro Horikawa et al.

It is certified that error appears in the above-identified patent and that said Letters Patent is hereby corrected as shown below:

IN THE CLAIMS

In column 23, claim 1, line 12, "faulted after the exposure" should read --formed after the exposure--.

Signed and Sealed this
Fifth Day of April, 2011

David J. Kappos

David J. Kappos
*Director of the United States Patent and Trademark Office*